US009035569B2

(12) United States Patent
Yokosawa et al.

(10) Patent No.: US 9,035,569 B2
(45) Date of Patent: May 19, 2015

(54) LIGHTING APPARATUS, LIGHTING SYSTEM, AND CONTROL METHOD

(71) Applicant: Sony Corporation, Tokyo (JP)

(72) Inventors: Nobuyuki Yokosawa, Saitama (JP); Bunichi Obana, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/247,728

(22) Filed: Apr. 8, 2014

(65) Prior Publication Data

US 2014/0306619 A1 Oct. 16, 2014

(30) Foreign Application Priority Data

Apr. 16, 2013 (JP) ..... 2013-085910

(51) Int. Cl.
*H05B 37/02* (2006.01)

(52) U.S. Cl.
CPC ..... *H05B 37/02* (2013.01); *H05B 37/0272* (2013.01)

(58) Field of Classification Search
None
See application file for complete search history.

(56) References Cited

U.S. PATENT DOCUMENTS

| | | | | |
|---|---|---|---|---|
| 4,891,563 | A * | 1/1990 | Ganser et al. | 315/309 |
| 8,362,706 | B1 * | 1/2013 | Godbole | 315/291 |
| 8,564,223 | B2 * | 10/2013 | Ho et al. | 315/307 |
| 2006/0038510 | A1 * | 2/2006 | Lee et al. | 315/291 |
| 2007/0052372 | A1 * | 3/2007 | Ryu | 315/291 |
| 2007/0138975 | A1 * | 6/2007 | Suganuma et al. | 315/291 |
| 2010/0176744 | A1 * | 7/2010 | Lee et al. | 315/294 |
| 2011/0248646 | A1 * | 10/2011 | Beyer et al. | 315/294 |

FOREIGN PATENT DOCUMENTS

| | | |
|---|---|---|
| JP | 2004-184768 | 7/2004 |
| JP | 2008-104022 | 5/2008 |
| JP | 2010-040267 | 2/2010 |

* cited by examiner

*Primary Examiner* — Crystal L Hammond
(74) *Attorney, Agent, or Firm* — Dentons US LLP

(57) ABSTRACT

A lighting apparatus includes a power supply circuit, a light-emitting unit, a mounting unit, and a lighting-side controller. The light-emitting unit is configured to drive light emission based on a power supply voltage generated by the power supply circuit. The mounting unit is configured to detachably mount an electronic apparatus including an apparatus-side controller and an apparatus function unit controlled by the apparatus-side controller. The lighting-side controller is configured to perform control to supply an operating voltage based on the power supply voltage to the apparatus-side controller of the electronic apparatus mounted to the mounting unit to perform authentication processing with the apparatus-side controller, and perform, based on a result of the authentication processing, control to supply the operating voltage based on the power supply voltage to the apparatus function unit.

18 Claims, 18 Drawing Sheets

6

8

LIGHTING APPARATUS, LIGHTING SYSTEM, AND CONTROL METHOD

CROSS REFERENCE TO RELATED APPLICATIONS

This application claims the benefit of Japanese Priority Patent Application JP 2013-085910 filed Apr. 16, 2013, the entire contents of which are incorporated herein by reference.

BACKGROUND

The present disclosure relates to a technical field on a lighting apparatus capable of detachably mounting an electronic apparatus, a lighting system including a lighting apparatus and an electronic apparatus, and a control method for a lighting system.

As disclosed in Japanese Patent Application Laid-open Nos. 2008-104022 and 2010-40267, a lighting system in which a lighting apparatus and an electronic apparatus are combined is known.

For example, Japanese Patent Application Laid-open No. 2008-104022 discloses a lighting system in which a plurality of speakers for forming a multi-surround system are formed integrally with a lighting apparatus attached to a ceiling.

Japanese Patent Application Laid-open No. 2010-40267 discloses a lighting system in which a lighting apparatus and a negative ion generator are combined.

Additionally, Japanese Patent Application Laid-open No. 2004-184768 discloses a lighting system in which a lighting apparatus and a projector apparatus are combined.

SUMMARY

Examples of the lighting system in which the lighting apparatus and the electronic apparatus are combined include a system capable of detachably mounting an electronic apparatus to a lighting apparatus and causing a user to replace different types of electronic apparatuses at user's disposal. Alternatively, it may also be conceivable that a user replaces an electronic apparatus with another one that is a new product having the same type as that of the previously provided one but having improved function and performance. In general, the lighting apparatus has a long product life cycle (during which a model change and significant improvement in function and performance are performed), and hence such a system capable of replacing the electronic apparatus is effective.

However, the system capable of replacing the electronic apparatus has points to be considered in terms of the safety of the product and power supply to the electronic apparatus, as compared to a system in which the detachment is not assumed.

It is desirable to achieve improvement in reliability of a lighting system as a product, which is capable of detachably mounting an electronic apparatus by reducing power consumption and improving safety.

According to an embodiment of the present disclosure, first, there is provided a lighting apparatus including a power supply circuit, a light-emitting unit, a mounting unit, and a lighting-side controller. The light-emitting unit is configured to drive light emission based on a power supply voltage generated by the power supply circuit. The mounting unit is configured to detachably mount an electronic apparatus including an apparatus-side controller and an apparatus function unit controlled by the apparatus-side controller. The lighting-side controller is configured to perform control to supply an operating voltage based on the power supply voltage to the apparatus-side controller of the electronic apparatus mounted to the mounting unit to perform authentication processing with the apparatus-side controller, and perform, based on a result of the authentication processing, control to supply the operating voltage based on the power supply voltage to the apparatus function unit.

With the above configuration, the supply of the operating voltage from the lighting apparatus to the apparatus function unit of the electronic apparatus is not performed only by the electronic apparatus being mounted to the mounting unit but performed based on the result of the authentication processing.

Second, in the lighting apparatus according to the embodiment of the present disclosure, the mounting unit may desirably be configured to be capable of mounting a unit to be mounted that is provided to the electronic apparatus and has a structure common to the electronic apparatus, the electronic apparatus including a plurality of types of electronic apparatuses each including the apparatus function unit having a different function.

This allows the plurality of types of electronic apparatuses to be replaced with one another.

Third, in the lighting apparatus according to the embodiment of the present disclosure, the lighting-side controller may desirably be configured to perform, when the authentication processing fails, control to stop power supply to the apparatus-side controller.

Thus, the power supply to the electronic apparatus that fails in the authentication is completely shut down.

Fourth, the lighting apparatus according to the embodiment of the present disclosure may desirably further include a voltage level adjustment unit configured to transform the power supply voltage generated by the power supply circuit to have a requested voltage level and output the transformed power supply voltage, in which the lighting-side controller may desirably be configured to cause the voltage level adjustment unit to generate a voltage at a level corresponding to the electronic apparatus mounted to the mounting unit.

Thus, it is possible to support a case where each electronic apparatus has a different requested voltage level of the apparatus function unit.

Fifth, in the lighting apparatus according to the embodiment of the present disclosure, the lighting-side controller may desirably be configured to control a light-emitting operation of the light-emitting unit in accordance with an operating state of the mounted electronic apparatus.

Thus, the light-emitting operation of the light-emitting unit is controlled to interlock with the operating state of the electronic apparatus.

Sixth, the lighting apparatus according to the embodiment of the present disclosure may desirably further include a communication unit for performing data communication with an information processing apparatus.

This allows an operation interlocking with the information processing apparatus to be achieved.

Seventh, in the lighting apparatus according to the embodiment of the present disclosure, the apparatus function unit of the electronic apparatus may desirably have one of a content data reproduction and output function and a content data acquisition function, and the lighting-side controller may desirably be configured to execute any one of processing of transferring, to the electronic apparatus, content data received by the communication unit from the information processing apparatus and processing of transferring, to the information processing apparatus via the communication unit, content data received from the electronic apparatus.

Thus, this allows the electronic apparatus to reproduce and output the content data stored in the information processing apparatus and the information processing apparatus to reproduce and output the content data acquired by the electronic apparatus.

Eighth, in the lighting apparatus according to the embodiment of the present disclosure, the communication unit may desirably be configured to be capable of performing communication by wireless fidelity (Wi-Fi) and communication by a wireless communication standard other than the Wi-Fi, and the lighting-side controller may desirably be configured to cause, when the content data is sound data, the communication unit to execute the communication by the wireless communication standard other than the Wi-Fi.

Thus, in the case where the sound content is reproduced and output, the information processing apparatus is connectable to the Internet via the Wi-Fi.

According to another embodiment of the present disclosure, first, there is provided a lighting system including an electronic apparatus and a lighting apparatus, the electronic apparatus including an apparatus-side controller and an apparatus function unit controlled by the apparatus-side controller, the lighting apparatus including a power supply circuit, a light-emitting unit configured to drive light emission based on a power supply voltage generated by the power supply circuit, a mounting unit configured to detachably mount the electronic apparatus, and a lighting-side controller configured to perform control to supply an operating voltage based on the power supply voltage to the apparatus-side controller of the electronic apparatus mounted to the mounting unit to perform authentication processing with the apparatus-side controller, and perform, based on a result of the authentication processing, control to supply the operating voltage based on the power supply voltage to the apparatus function unit.

Also with the lighting system according to the embodiment of the present disclosure, as in the case of the lighting apparatus according to the embodiment of the present disclosure described above, the supply of the operating voltage from the lighting apparatus to the apparatus function unit of the electronic apparatus is not performed only by the electronic apparatus being mounted to the mounting unit but performed based on the result of the authentication processing.

Second, in the lighting system according to the embodiment of the present disclosure, the mounting unit may desirably be configured to be capable of mounting a unit to be mounted that is provided to the electronic apparatus and has a structure common to the electronic apparatus, the electronic apparatus including a plurality of types of electronic apparatuses each including the apparatus function unit having a different function.

This allows the plurality of types of electronic apparatuses to be replaced with one another.

Third, in the lighting system according to the embodiment of the present disclosure, the lighting-side controller may desirably be configured to perform, when the authentication processing fails, control to stop power supply to the apparatus-side controller.

Thus, the power supply to the electronic apparatus that fails in the authentication is completely shut down.

Fourth, in the lighting system according to the embodiment of the present disclosure, the electronic apparatus may desirably include a voltage transformer circuit configured to transform the operating voltage supplied from the lighting apparatus based on the result of the authentication processing to have a predetermined voltage level and output the transformed operating voltage to the apparatus function unit.

Thus, it is possible to support a case where each electronic apparatus has a different requested voltage level of the apparatus function unit.

Fifth, in the lighting system according to the embodiment of the present disclosure, the lighting-side controller may desirably be configured to control a light-emitting operation of the light-emitting unit in accordance with an operating state of the mounted electronic apparatus.

Thus, the light-emitting operation of the light-emitting unit is controlled to interlock with the operating state of the electronic apparatus.

Sixth, the lighting system according to the embodiment of the present disclosure may desirably further include an information processing apparatus and a communication unit for performing one of data communication between the information processing apparatus and the lighting-side controller and data communication between the information processing apparatus and the apparatus-side controller.

This allows an operation interlocking with the information processing apparatus to be achieved.

Seventh, in the lighting system according to the embodiment of the present disclosure, the apparatus function unit of the electronic apparatus may desirably have one of a content data reproduction and output function and a content data acquisition function, the communication unit may desirably include a lighting-side communication unit provided to the lighting apparatus, and the lighting-side controller may desirably be configured to execute any one of processing of transferring, to the electronic apparatus, content data received by the lighting-side communication unit from the information processing apparatus and processing of transferring, to the information processing apparatus via the lighting-side communication unit, content data received from the electronic apparatus.

Thus, this allows the electronic apparatus to reproduce and output the content data stored in the information processing apparatus and the information processing apparatus to reproduce and output the content data acquired by the electronic apparatus.

Eighth, in the lighting system according to the embodiment of the present disclosure, the apparatus function unit of the electronic apparatus may desirably have one of a content data reproduction and output function and a content data acquisition function, the communication unit may desirably include an apparatus-side communication unit provided to the electronic apparatus, and the apparatus-side controller may desirably be configured to execute any one of processing of causing the apparatus function unit to reproduce and output content data received by the apparatus-side communication unit from the information processing apparatus and processing of causing the apparatus-side communication unit to transmit content data acquired by the apparatus function unit to the information processing apparatus.

Thus, this also allows the electronic apparatus to reproduce and output the content data stored in the information processing apparatus and the information processing apparatus to reproduce and output the content data acquired by the electronic apparatus.

Ninth, in the lighting system according to the embodiment of the present disclosure, the communication unit may desirably be configured to be capable of performing communication by Wi-Fi and communication by a wireless communication standard other than the Wi-Fi, and one of the lighting-side controller and the apparatus-side controller may desirably be configured to cause, when the content data is sound data, the communication unit to execute the communication by the wireless communication standard other than the Wi-Fi.

Thus, in the case where the sound content is reproduced and output, the information processing apparatus is connectable to the Internet via the Wi-Fi.

According to the present disclosure, it is possible to prevent power from being uselessly supplied to the power output terminal of the lighting apparatus and thus achieve a reduction in power consumption.

Further, the power is not allowed to be supplied to the power output terminal in a state where the electronic apparatus is not mounted. This prevents an electric shock from occurring when a user wrongly touches the power output terminal, for example.

Furthermore, the power is not allowed to be supplied to the apparatus function unit of an unauthorized electronic apparatus, that is, an unofficial electronic apparatus. This is desirable in terms of security.

Consequently, according to the present disclosure, the reliability of the lighting system as a product, which is capable of detachably mounting the electronic apparatus, can be improved.

These and other objects, features and advantages of the present disclosure will become more apparent in light of the following detailed description of best mode embodiments thereof, as illustrated in the accompanying drawings.

DETAILED DESCRIPTION OF EMBODIMENTS

Hereinafter, embodiments of the present disclosure will be described.

The description will be given in the following order.

1. First Embodiment
(1-1. General Outline of Lighting System)
(1-2. Configurations of Lighting Apparatus and Electronic Apparatus)
(1-3. Control Method of First Embodiment)
(1-4. Conclusion of First Embodiment)
2. Second Embodiment
(2-1. System Configuration)
(2-2. Control Method of Second Embodiment)
(2-3. Conclusion of Second Embodiment)
3. Modified Examples
(3-1. Modified Example 1)
(3-2. Modified Example 2)
(3-3. Modified Example 3)
(3-4. Other Modified Examples)
4. Present Disclosure 1. First Embodiment (1-1. General Outline of Lighting System)

Figure 1:
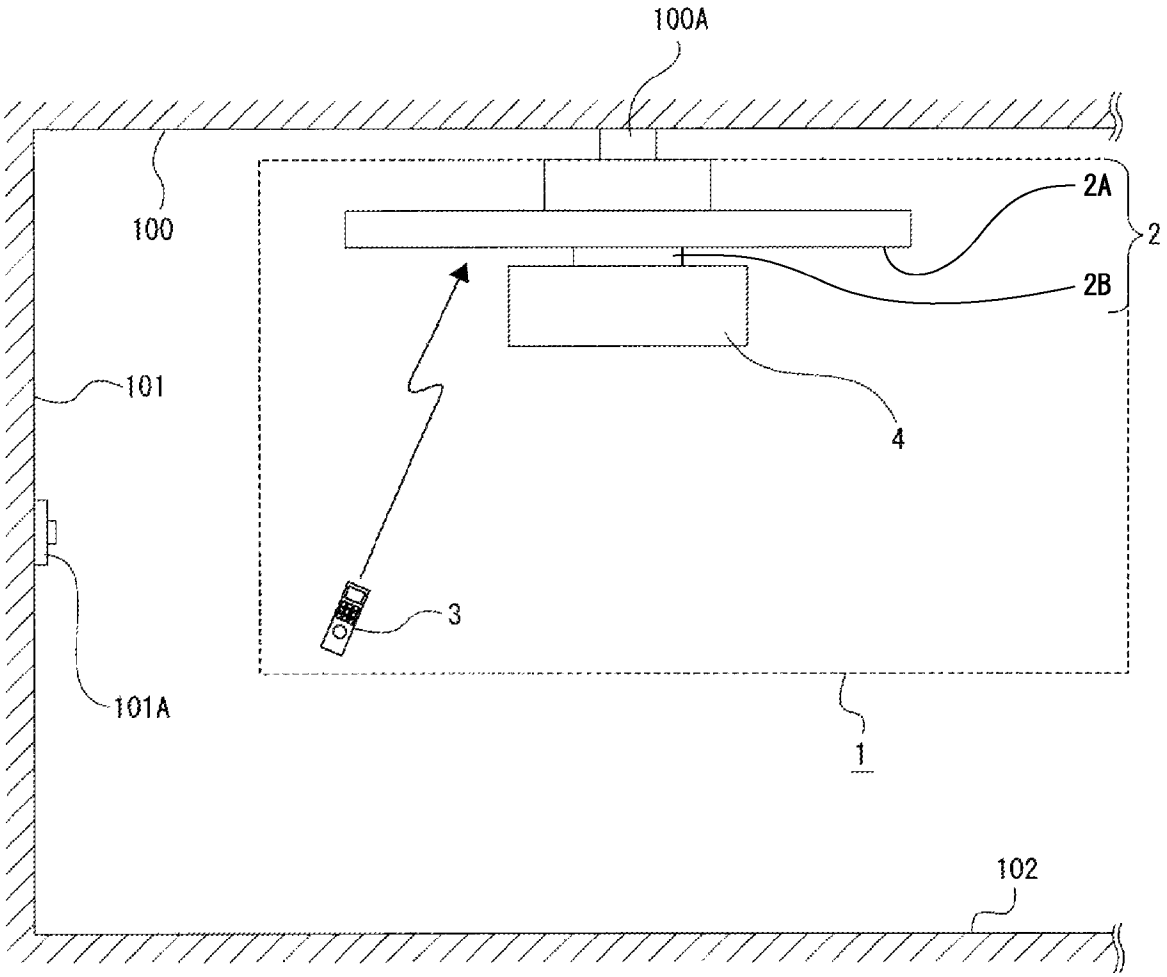
FIG. 1 is a diagram for describing a general outline of a configuration of a lighting system according to a first embodiment.

FIG. 1 is a diagram for describing a general outline of a configuration of a lighting system 1 according to a first embodiment of the present disclosure.

The lighting system 1 according to this embodiment includes a lighting apparatus 2, a remote controller 3 for operating the lighting apparatus 2, and an electronic apparatus 4 that is detachably mounted to the lighting apparatus 2.

The lighting apparatus 2 is a room lighting apparatus and is attached to a ceiling rosette 100A provided to a ceiling surface 100 in a room.

The lighting apparatus 2 includes a light-emitting surface 2A from which light for illuminating the room is emitted, and a mounting unit 2B for detachably mounting the electronic apparatus 4. In this example, an area of light emission on the light-emitting surface 2A is formed to have a predetermined shape such as an annular shape (doughnut shape), and the mounting unit 2B is provided on an inner side of the annular light emission area on the light-emitting surface 2A (that is, in the center portion of the light-emitting surface 2A) so as to maintain the electronic apparatus 4 below the light-emitting surface 2A (floor surface 102 side of the room).

A position at which the mounting unit 2B is provided only needs to be determined such that the mounted electronic apparatus 4 does not adversely affect a light distribution pattern to the room, and thus the position of the mounting unit 2B is not limited to the position as described above.

In this system, it is assumed that a plurality of types of electronic apparatuses 4 having different functions are used. Examples of the electronic apparatus 4 include a sound reproduction apparatus including a speaker, a projector apparatus, a camera apparatus, an ion generator, a fire alarm notification appliance, and a home planetarium apparatus.

Those various electronic apparatuses 4 having different functions are provided with a unit to be mounted that has a common structure in order to support the lighting system 1 of this example. The mounting unit 2B in the lighting apparatus 2 is configured to detachably mount the unit to be mounted.

Examples of a specific mechanism for detachably mount the unit to be mounted include an engagement mechanism using a hook portion, a screw mechanism, and a detachment mechanism using a magnetic force. Under whatever circumstances, the configuration for detachably mounting the electronic apparatus 4 is not limited to a specific configuration and various configurations can be adopted.

When the lighting apparatus 2 is attached to the ceiling rosette 100A, an input of a commercial alternating-current (AC) power supply is allowed. The input of the commercial AC power supply to the lighting apparatus 2 is turned on and off with a wall switch 101A provided to a wall surface 101 of the room.

(1-2. Configurations of Lighting Apparatus and Electronic Apparatus)

Figure 2:
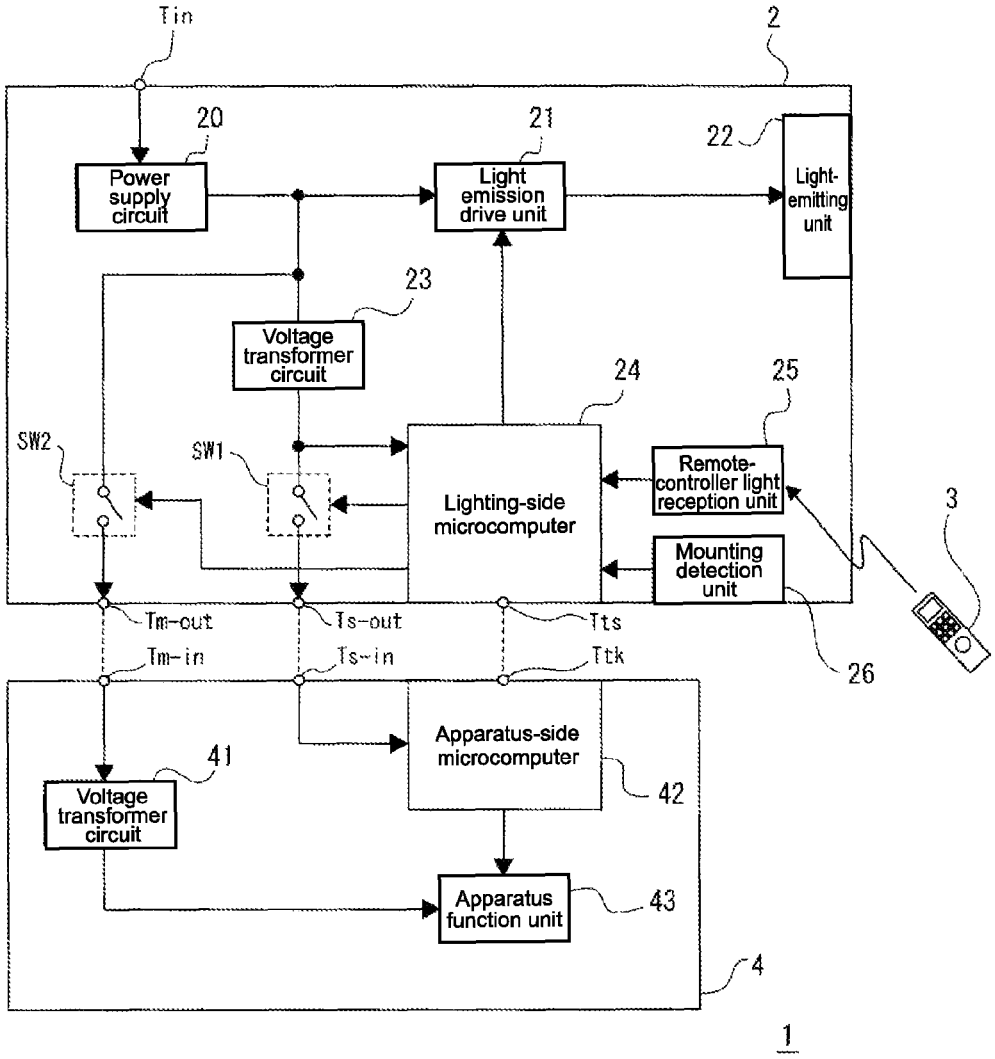
FIG. 2 is an explanatory diagram of internal configurations of a lighting apparatus and an electronic apparatus that form the lighting system according to the first embodiment.

FIG. 2 is an explanatory diagram of internal configurations of the lighting apparatus 2 and the electronic apparatus 4 that form the lighting system 1. The remote controller 3 is also shown in FIG. 2.

The lighting apparatus 2 includes a power supply circuit 20, a light emission drive unit 21, a light-emitting unit 22, a voltage transformer circuit 23, a lighting-side microcomputer 24, a remote-controller light reception unit 25, a mounting detection unit 26, a switch SW1, a switch SW2, a power-supply input terminal Tin, a power output terminal Tm-out, a power output terminal Ts-out, and a data communication terminal Tts.

The power of the commercial AC power supply is input to the power supply circuit 20 via the power-supply input terminal Tin.

The power supply circuit 20 includes an AC-DC (direct-current) converter and generates a DC voltage at a predetermined level based on the input power of the commercial AC power supply.

The DC voltage generated by the power supply circuit 20 is supplied to the light emission drive unit 21, the voltage transformer circuit 23, and the switch SW2.

The switch SW2 turns on and off power supply from the power supply circuit 20 to the power output terminal Tm-out according to an instruction from the lighting-side microcomputer 24. It should be noted that the switch SW2 is turned off in the initial state.

The light emission drive unit 21 inputs the DC voltage supplied from the power supply circuit 20 as an operating voltage and generates a drive signal for driving light emission of a light-emitting device that forms the light-emitting unit 22 according to an instruction from the lighting-side microcomputer 24.

In this example, the light-emitting device that forms the light-emitting unit 22 is a light-emitting diode (LED). In accordance with this, the light emission drive unit 21 is provided with a constant current circuit for generating a constant current at a predetermined level based on the DC voltage to generate the above-mentioned drive signal based on an output current by the constant current circuit.

In this example, the light-emitting unit 22 includes a plurality of LEDs and the light emission drive unit 21 selects an LED to which the drive signal is given, thus adjusting the amount of light emitted from the light-emitting unit 22 (dimming control).

In accordance with the light emission of the light-emitting unit 22, the light is emitted from the light-emitting surface 2A described with reference to FIG. 1.

It should be noted that the light-emitting unit 22 can be detachably formed with respect to the lighting apparatus 2 in consideration of maintenance performance and the like.

The voltage transformer circuit 23 transforms the DC voltage, which is supplied from the power supply circuit 20, to have a predetermined level. The transformed DC voltage is supplied to the lighting-side microcomputer 24 and also to the switch SW1.

The switch SW1 turns on and off power supply from the voltage transformer circuit 23 to the power output terminal Ts-out according to an instruction from the lighting-side microcomputer 24. It should be noted that the switch SW1 is also turned off in the initial state as in the switch SW2.

The lighting-side microcomputer 24 includes, for example, a CPU (Central Processing Unit), a ROM (Read Only Memory), and a RAM (Random Access Memory) serving as a work area and performs overall control of the lighting apparatus 2.

The lighting-side microcomputer 24 is connected to the remote-controller light reception unit 25. The remote-controller light reception unit 25 is an infrared-ray reception unit and receives an infrared signal transmitted from the remote controller 3 to obtain an operating input signal. The lighting-side microcomputer 24 instructs the light emission drive unit 21 to execute the dimming control described above based on the operating input signal obtained by the remote-controller light reception unit 25. Further, in response to an operating input signal for instructing a turning off of the lighting, the lighting-side microcomputer 24 instructs the light emission drive unit 21 to turn off all the light-emitting devices of the light-emitting unit 22.

Additionally, the lighting-side microcomputer 24 is connected to the mounting detection unit 26.

The mounting detection unit 26 detects the mounting of the electronic apparatus 4 to the lighting apparatus 2. The mounting detection unit 26 in this example includes a mechanism unit and a switch. The mechanism unit operates in accordance with the attachment and detachment of the electronic apparatus 4 to the lighting apparatus 2. The switch is turned on and off in accordance with the operation of the mechanism unit. Specifically, for example, the mounting detection unit 26 includes a mechanism unit that is pulled and retracted in accordance with the attachment and detachment of the electronic apparatus 4, and a switch that is turned on and off in conjunction with the pull and the retraction of the mechanism unit.

A detection signal is generated so as to represent an attached or detached state of the electronic apparatus 4 by the mounting detection unit 26 as described above and is transmitted to the lighting-side microcomputer 24.

Further, the lighting-side microcomputer 24 is connected to the data communication terminal Tts for performing data communication with an apparatus-side microcomputer 42 that will be described later.

The electronic apparatus 4 will be described next.

The electronic apparatus 4 includes a voltage transformer circuit 41, the apparatus-side microcomputer 42, an apparatus function unit 43, a power input terminal Tm-in, a power input terminal Ts-in, and a data communication terminal Ttk.

The voltage transformer circuit 41 transforms the DC voltage, which is input from the power input terminal Tm-in, to have a predetermined level and outputs the transformed DC voltage to the apparatus function unit 43. Specifically, the voltage transformer circuit 41 transforms the DC voltage, which is input from the power input terminal Tm-in, to have a voltage level requested by the apparatus function unit 43 and outputs the transformed DC voltage.

The apparatus function unit 43 comprehensively represents the configurations of units to be controlled by the apparatus-side microcomputer 42. The apparatus function unit 43 contains a main configuration for achieving a function as the electronic apparatus 4. For example, in the case where the electronic apparatus 4 is a sound reproduction apparatus, the apparatus function unit 43 is provided with a configuration for achieving a sound reproduction function, such as a speaker and an amplifier. Alternatively, in the case where the electronic apparatus 4 is a camera apparatus, the apparatus function unit 43 is provided with a configuration for achieving a function of acquiring captured image data, such as an imaging optical system and an image processing unit.

The apparatus-side microcomputer 42 includes a CPU, a ROM, and a RAM and controls the apparatus function unit 43. The apparatus-side microcomputer 42 operates by the DC voltage input from the power input terminal Ts-in.

The apparatus-side microcomputer 42 is connected to the data communication terminal Ttk for performing data communication with the lighting-side microcomputer 24.

Further, in the ROM of the apparatus-side microcomputer 42, authentication information used for authentication processing that will be described later is stored. In this example, information on at least an authentication key is stored as the authentication information.

Here, regarding the power output terminal Tm-out, the power output terminal Ts-out, and the data communication terminal Tts that are provided to the lighting apparatus 2 side and the power input terminal Tm-in, the power input terminal Ts-in, and the data communication terminal Ttk that are provided to the electronic apparatus 4 side, "the power output terminal Tm-out and the power input terminal Tm-in" are connected to each other, "the power output terminal Ts-out and the power input terminal Ts-in" are connected to each other, and "the data communication terminal Tts and the data communication terminal Ttk" are connected to each other in response to the mounting of the electronic apparatus 4 to the lighting apparatus 2. In other words, in response to the mounting of the electronic apparatus 4 to the lighting apparatus 2, the lighting system 1 enters a state where power supply from the lighting apparatus 2 side to the electronic apparatus 4 side (supply of the operating voltage) and data communication between the lighting-side microcomputer 24 and the apparatus-side microcomputer 42 can be performed.

(1-3. Control Method of First Embodiment)

Figure 3:
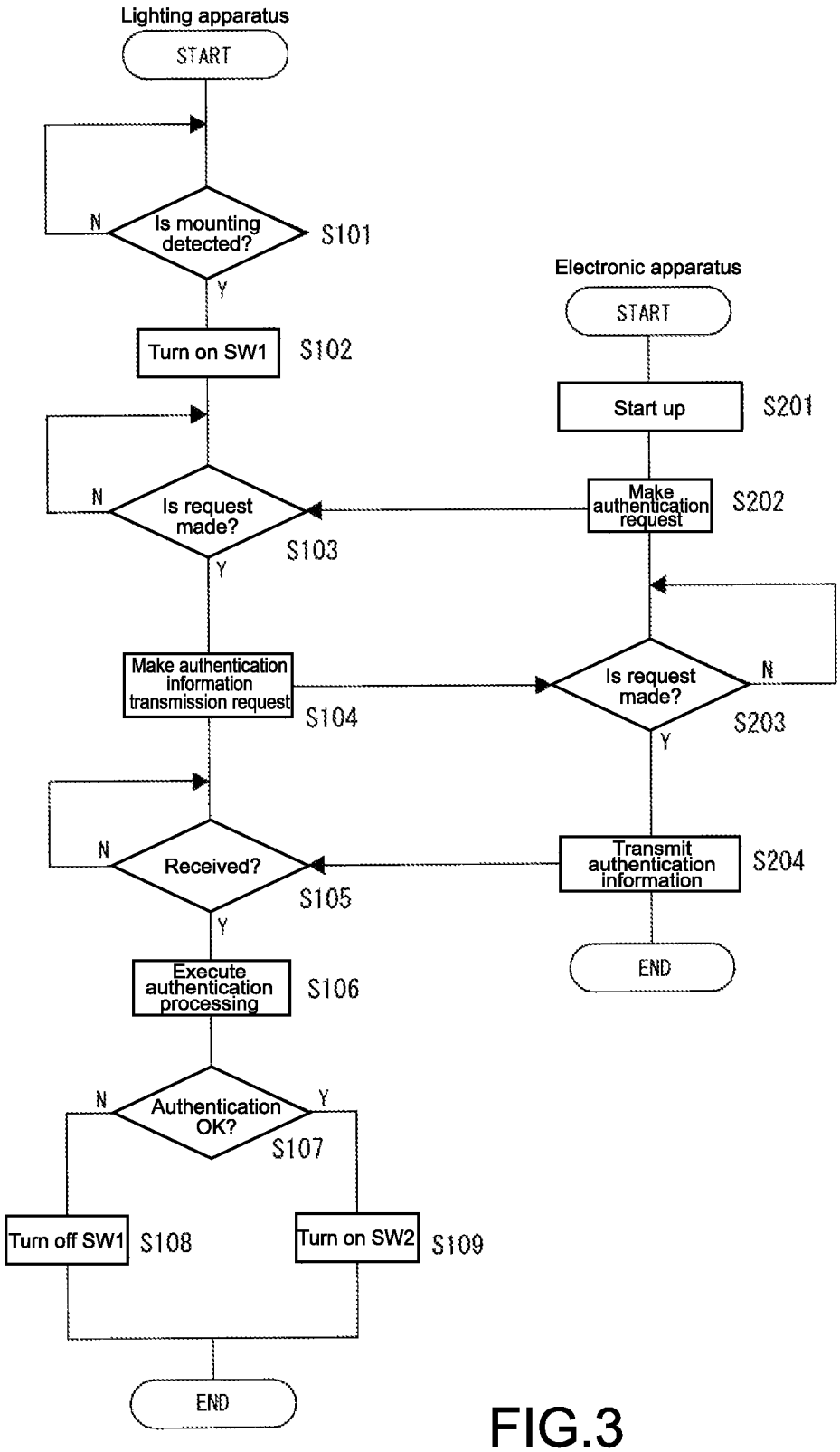
FIG. 3 is a flowchart for describing processing executed in the lighting system according to the first embodiment.

With reference to FIG. 3, a control method of the first embodiment will be described.

FIG. 3 is a flowchart for describing processing executed in the lighting system 1. In FIG. 3, processing of the "lighting apparatus" is processing executed by the lighting-side microcomputer 24 based on a program stored in its ROM, and processing by the "electronic apparatus" is processing executed by the apparatus-side microcomputer 42 based on a program stored in its ROM.

It is assumed that when the processing shown in FIG. 3 starts, the above-mentioned wall switch 101A is in an on state and the power of the commercial AC power supply is input to the lighting apparatus 2.

First, in Step S101, the lighting apparatus 2 waits until the electronic apparatus 4 is mounted. In other words, the lighting apparatus 2 waits until the mounting of the electronic apparatus 4 is detected based on the detection signal by the mounting detection unit 26.

In the case where the electronic apparatus 4 is mounted, in Step S102, the switch SW1 is turned on. The switch SW1 is turned on, and thus the supply of the operating voltage from the power output terminal Ts-out to the apparatus-side microcomputer 42 via the power input terminal Ts-in is started. In other words, the apparatus-side microcomputer 42 is activated.

In such a manner, the apparatus-side microcomputer 42, which is activated in response to the supply of the operating voltage, first executes start-up processing in Step S201. Subsequently, upon completion of the start-up processing, the apparatus-side microcomputer 42 makes an authentication request to the lighting apparatus 2 in Step S202.

In Step S103 of FIG. 3, the lighting apparatus 2 waits until an authentication request is made by the electronic apparatus 4 in Step S202 described above. In response to the authentication request, the lighting apparatus 2 makes an authentication information transmission request to the electronic apparatus 4 in Step S104.

In Step S203 of FIG. 3, the electronic apparatus 4 waits until a transmission request is made by the lighting apparatus 2 in Step S104 described above. In response to the transmission request, the electronic apparatus 4 transmits the authentication information to the lighting apparatus 2 in Step S204 and terminates the processing.

In Step S105 of FIG. 3, the lighting apparatus 2 waits until the authentication information from the electronic apparatus 4 is received.

When the authentication information is received, the lighting apparatus 2 executes the authentication processing in Step S106 and determines whether the authentication succeeds or not in Step S107.

When a negative result representing that the authentication fails (authentication failure) is obtained, the lighting apparatus 2 proceeds to Step S108 to turn off the switch SW1 and terminates the processing. The switch SW1 is turned off in such a manner, and thus the power supply to the electronic apparatus 4 that fails in the authentication is completely shut down.

Alternatively, when a positive result representing that the authentication succeeds is obtained, the lighting apparatus 2 proceeds to Step S109 to turn on the switch SW2 and terminates the processing. The switch SW2 is turned on in such a manner, and thus the electronic apparatus 4 that succeeds in the authentication is permitted to supply power to the apparatus function unit 43.

(1-4. Conclusion of First Embodiment)

As described above, in the first embodiment, the lighting-side microcomputer 24 performs the control to supply the operating voltage to the apparatus-side microcomputer 42 of the electronic apparatus 4 mounted to the mounting unit 2B, perform the authentication processing with the apparatus-side microcomputer 42, and performs the control to supply the operating voltage to the apparatus function unit 43 of the electronic apparatus 4 based on the result of the authentication processing.

With this operation, the supply of the operating voltage from the lighting apparatus 2 to the apparatus function unit 43 of the electronic apparatus 4 is not performed only by the electronic apparatus 4 being mounted to the mounting unit 2B but performed based on the result of the authentication processing.

Thus, it is possible to prevent the power from being uselessly supplied to the power output terminal Tm-out of the lighting apparatus 2 and thus achieve a reduction in power consumption.

Further, the power is not allowed to be supplied to the power output terminal Tm-out in a state where the electronic apparatus 4 is not mounted. This prevents an electric shock from occurring when a user wrongly touches the power output terminal Tm-out, for example.

Furthermore, the power is not allowed to be supplied to the apparatus function unit 43 of an unauthorized electronic apparatus 4, that is, an unofficial electronic apparatus 4. This is desirable in terms of security.

Consequently, according to this embodiment, the reliability of the lighting system as a product, which is capable of detachably mounting the electronic apparatus, can be improved.

Additionally, in this embodiment, the plurality of types of electronic apparatuses 4 whose apparatus function units 43 have different functions are each provided with a unit to be mounted having a common structure, and the mounting unit 2B is configured to be capable of mounting the unit to be mounted.

This allows an achievement of a lighting system capable of replacing the plurality of types of electronic apparatuses 4 at user's disposal.

Further, in this embodiment, in the case where the lighting-side microcomputer 24 fails the authentication processing with the electronic apparatus 4, the lighting-side microcomputer 24 performs the control to stop the power supply to the apparatus-side microcomputer 42.

This allows the complete shut-down of the power supply to the electronic apparatus that fails in authentication and allows a further reduction in power consumption.

Furthermore, in this embodiment, the electronic apparatus 4 includes the voltage transformer circuit 41 that transforms the operating voltage, which is supplied based on the result of the authentication processing, to have a predetermined voltage level and outputs the transformed operating voltage to the apparatus function unit 43.

Here, in the case of using a system in which the plurality of types of electronic apparatuses 4 can be replaced at user's disposal as in this embodiment, the fact that a voltage level requested for each electronic apparatus 4 may differ has to be considered.

With the voltage transformer circuit 41 as described above, a case where a voltage level requested for each electronic apparatus 4 differs can be supported.

Further, since the voltage is transformed in the electronic apparatus 4 in accordance with the requested voltage level, the lighting apparatus 2 does not need to have a configuration for performing a voltage transformation for each electronic apparatus 4 to be mounted. Thus, the number of components of the lighting apparatus 2 can be reduced and the reduction in size and costs of the apparatus can be achieved.

2. Second Embodiment (2-1. System Configuration)

Figure 4:
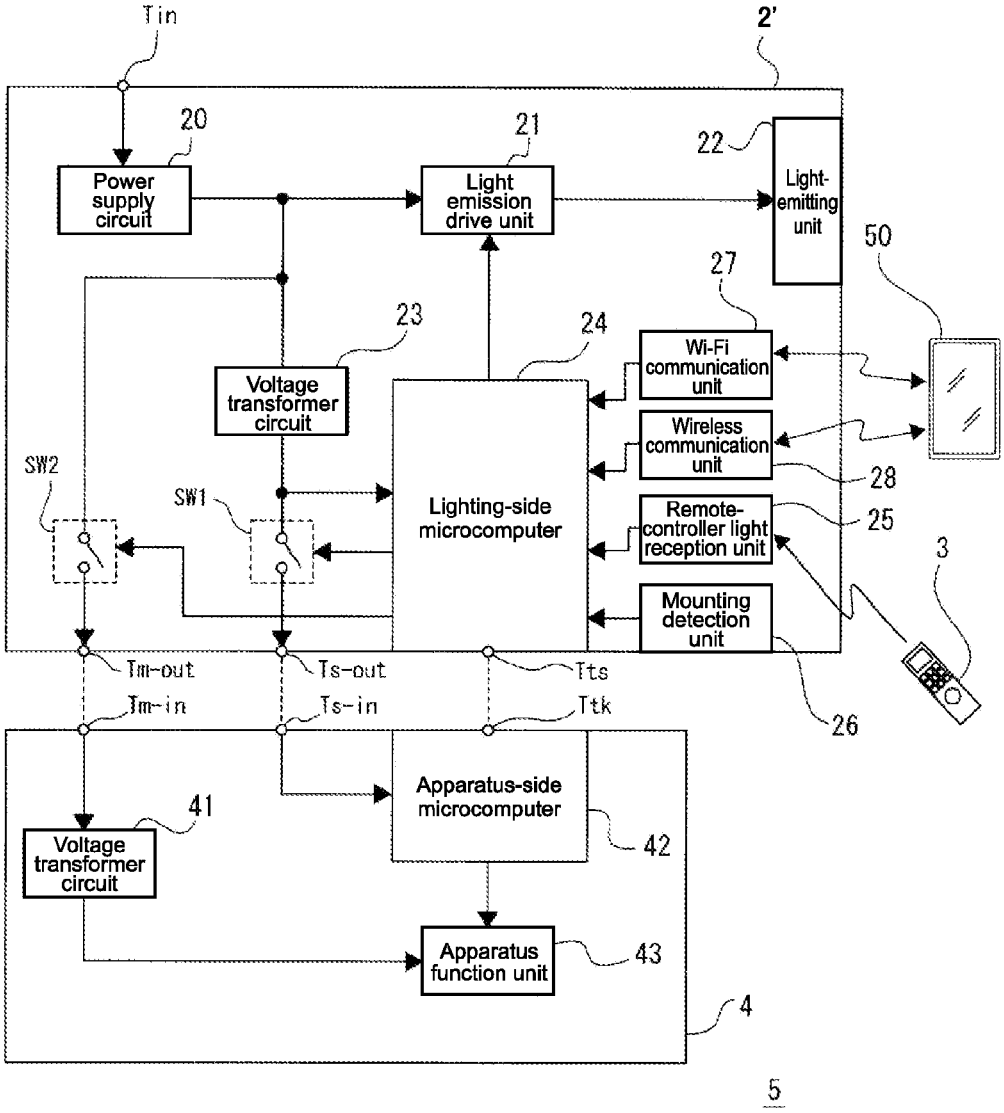
FIG. 4 is an explanatory diagram for describing a configuration of a lighting system according to a second embodiment.

FIG. 4 is an explanatory diagram for describing a configuration of a lighting system 5 according to a second embodiment.

It should be noted that in the following description, the parts already described above are denoted by the same reference symbols as those above and not described, and parts different from the above description will be mainly described.

The lighting system 5 of the second embodiment includes a lighting apparatus 2', a remote controller 3, an electronic apparatus 4, and an information processing apparatus 50.

The lighting apparatus 2' is different from the lighting apparatus 2 of the first embodiment in that a Wi-Fi (Wireless Fidelity) communication unit 27 and a wireless communication unit 28 are additionally provided.

Those Wi-Fi communication unit 27 and wireless communication unit 28 are connected to a lighting-side microcomputer 24 to perform wireless data communication between the lighting-side microcomputer 24 and a control unit of an external device (in this embodiment, a CPU 51 of the information processing apparatus 50).

The Wi-Fi communication unit 27 performs wireless data communication according to the IEEE802.11 standard.

The wireless communication unit 28 performs wireless data communication according to wireless communication standards other than Wi-Fi, and in this embodiment, performs wireless data communication according to a Bluetooth (registered trademark) standard.

The lighting-side microcomputer 24 and an apparatus-side microcomputer 42 in this embodiment execute the processing being the same as that described in the first embodiment and containing the processing shown in FIG. 3 described above. Further, those lighting-side microcomputer 24 and apparatus-side microcomputer 42 also execute processing shown in FIGS. 8 to 10, which will be described later.

Here, the lighting system 5 in this embodiment can be compatible with three types of apparatuses, i.e., a sound reproduction apparatus, a projector apparatus, and a camera apparatus as the electronic apparatuses 4.

Figure 5A:
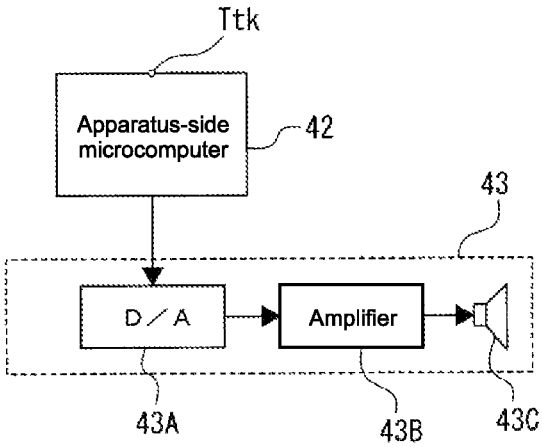
FIGS. 5A, 5B, and 5C are each an explanatory diagram on a configuration example of an apparatus function unit of the electronic apparatus.
Figure 5B:
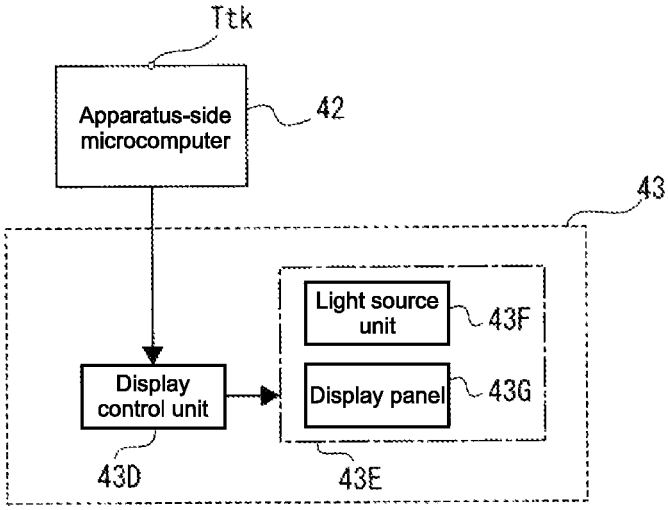
Figure 5C:
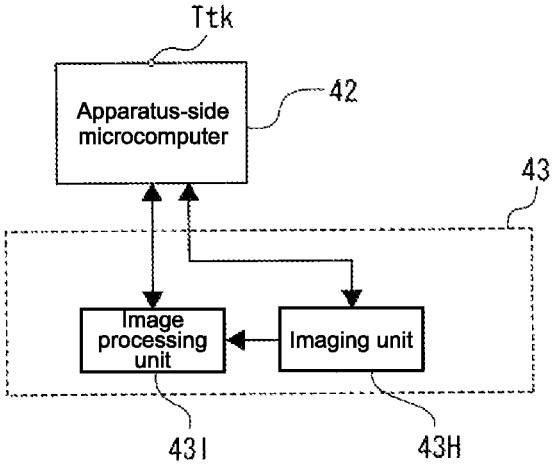

With reference to FIGS. 5A, 5B, and 5C, internal configurations of the electronic apparatuses 4 such as a sound reproduction apparatus, a projector apparatus, and a camera apparatus will be described. It should be noted that in each of FIGS. 5A, 5B, and 5C, only the apparatus-side microcomputer 42 and an apparatus function unit 43 are extracted for illustration.

In the case of a sound reproduction apparatus shown in FIG. 5A, a D/A converter 43A, an amplifier 43B, and a speaker 43C are provided in the apparatus function unit 43. The apparatus-side microcomputer 42 in this case decodes compressed audio data that is input via a data communication terminal Ttk and outputs audio data obtained by the decoding to the D/A converter 43A. An analog audio signal that is obtained in the D/A converter 43A and is based on the audio data is amplified by the amplifier 43B and is subsequently supplied to the speaker 43C as a speaker drive signal.

In the case of a projector apparatus shown in FIG. 5B, a display control unit 43D and an optical system 43E are provided in the apparatus function unit 43. As shown in FIG. 5B, a light source unit 43F and a display panel 43G are provided in the optical system 43E. The display panel 43G is a liquid crystal panel, for example.

The apparatus-side microcomputer 42 in this case decodes compressed image data that is input via the data communication terminal Ttk and outputs image data obtained by the decoding to the display control unit 43D. The display control unit 43D controls a display operation of the display panel 43G based on the input image data. In the optical system 43E, light emitted from the light source unit 43F passes through the display panel 43G to be subjected to an optical intensity modulation corresponding to the image data. In such a manner, the light under the intensity modulation is projected to a predetermined object (for example, to a screen provided near the wall surface 101) via a projection lens (not shown), so that an image is displayed.

It should be noted that the display control unit 43D also executes turning-on and turning-off control of the light source unit 43F, dimming control, and the like based on instructions from the apparatus-side microcomputer 42.

In the case of a camera apparatus shown in FIG. 5C, an imaging unit 43H and an image processing unit 43I are provided in the apparatus function unit 43. The imaging unit 43H includes, for example, an imaging device such as a CCD (Charge Coupled Device) image sensor and a CMOS (Complementary Metal Oxide Semiconductor) image sensor, a camera optical system for forming an image of the light coming from a subject on an imaging surface of the imaging device, a read-out circuit of the imaging device, and an A/D converter that performs A/D conversion on a captured-image signal obtained by the read-out circuit and obtains captured image data.

The image processing unit 43I performs predetermined image processing on the captured image data obtained by the imaging unit 43H and encodes the captured image data obtained after the image processing in a predetermined still image format such as a JPEG (Joint Photographic Experts Group) format and in a predetermined moving image format such as an AVCHD (Advanced Video Codec High Definition) format, to generate an image data file (compressed image data).

The apparatus-side microcomputer 42 in this case inputs the compressed image data obtained by the image processing unit 43I and executes processing of output via the data communication terminal Ttk.

Further, the apparatus-side microcomputer 42 in this case also executes control to give instructions on parameters for various types of image processing to the image processing unit 43I and control to cause the imaging unit 43H to adjust a focal length, an aperture, and the like.

Figure 6:
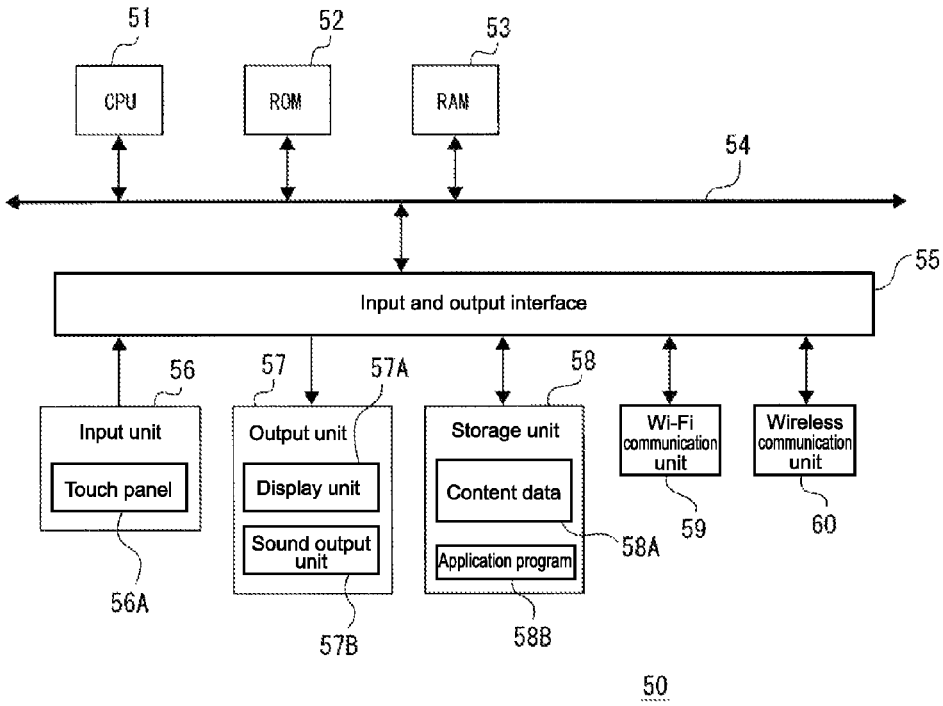
FIG. 6 is an explanatory diagram of an internal configuration of an information processing apparatus that forms the lighting system according to the second embodiment.

FIG. 6 is an explanatory diagram of an internal configuration of the information processing apparatus 50 that forms the lighting system 5.

The information processing apparatus 50 can be achieved by various types of computer apparatuses such as a smartphone, a tablet terminal, and a PC (personal computer).

In FIG. 6, the CPU 51 of the information processing apparatus 50 executes various types of processing according to a program stored in a ROM 52 or a program loaded from a storage unit 58 to a RAM 53. In the RAM 53, data necessary for the CPU 51 to execute various types of processing is stored, for example.

The CPU 51, the ROM 52, and the RAM 53 are connected to one another via a bus 54. Further, an input and output interface 55 is also connected to the bus 54.

The input and output interface 55 is connected to an input unit 56, an output unit 57, the storage unit 58, a Wi-Fi communication unit 59, and a wireless communication unit 60. The input unit 56 includes a touch panel 56A and various input devices. The output unit 57 includes a display unit 57A such as an LCD (Liquid Crystal Display) and an organic EL (Electroluminescence) panel and a sound output unit 57B such as a speaker. The storage unit 58 includes a hard disk, an SSD (Solid State Drive), and the like.

The Wi-Fi communication unit 59 performs wireless data communication according to the IEEE802.11 standard.

The Wi-Fi communication unit 59 establishes a connection with an external wireless LAN (Local Area Network) router, so that the Wi-Fi communication unit 59 is connectable to the Internet. Further, the Wi-Fi communication unit 59 can perform communication with the Wi-Fi communication unit 27 of the lighting apparatus 2' that performs wireless data communication according to the same Wi-Fi standard.

The wireless communication unit 60 performs wireless data communication according to wireless communication standards other than Wi-Fi, and in this example, performs wireless data communication according to a Bluetooth (registered trademark) standard. Thus, the wireless communication unit 60 can perform communication with the wireless communication unit 28 of the lighting apparatus 2'.

As described above, in the lighting system 5 of the second embodiment, the communication can be established between the lighting apparatus 2' and the electronic apparatus 4 and between the lighting apparatus 2' and the information processing apparatus 50. With such a system configuration, in the second embodiment, an operation of interlocking the information processing apparatus 50 and the electronic apparatus 4 mounted to the lighting apparatus 2' is achieved.

Specifically, in the case where the electronic apparatus 4 as a sound reproduction apparatus is mounted, sound content instructed for reproduction by the information processing apparatus 50 is reproduced and output (sound is output) by the electronic apparatus 4. Further, in the case where the electronic apparatus 4 as a projector apparatus is mounted, image content instructed for reproduction by the information processing apparatus 50 is reproduced and output (displayed) by the electronic apparatus 4. Furthermore, in the case where the electronic apparatus 4 as a camera apparatus is mounted, image content captured by the electronic apparatus 4 is reproduced and output (displayed) by the information processing apparatus 50.

At that time, the content data reproduced to correspond to the case where the electronic apparatus 4 serving as the sound reproduction apparatus or the projector apparatus is used is stored in the storage unit 58 of the information processing apparatus 50. In FIG. 6, this content data is represented as content data 58A.

Further, the storage unit 58 also stores an application program 58B functioning as a user interface used when the above-mentioned operation of interlocking the electronic apparatus 4 and the information processing apparatus 50 is achieved. The user activates the application program 58B to use an image displayed on the display unit 57A and a GUI (Graphical User Interface) achieved by an input device such as the touch panel 56A, so that various types of operation inputs according to the content reproduction and output operation as described above can be performed.

The application program 58B is downloaded from, for example, a predetermined server apparatus over the Internet and stored in the storage unit 58.

In this example, the application program 58B is prepared for each type of the electronic apparatus 4. In other words, three types of application programs are provided: an application program for a sound reproduction apparatus, which corresponds to the electronic apparatus 4 as the sound reproduction apparatus, an application program for a projector apparatus, which corresponds to the electronic apparatus 4 as the projector apparatus, and an application program for a camera apparatus, which corresponds to the electronic apparatus 4 as the camera apparatus. The application program 58B comprehensively represents those three types of application programs.

(2-2. Control Method of Second Embodiment)

With reference to FIGS. 7 to 10, the control method of the second embodiment will be described.

Figure 7:
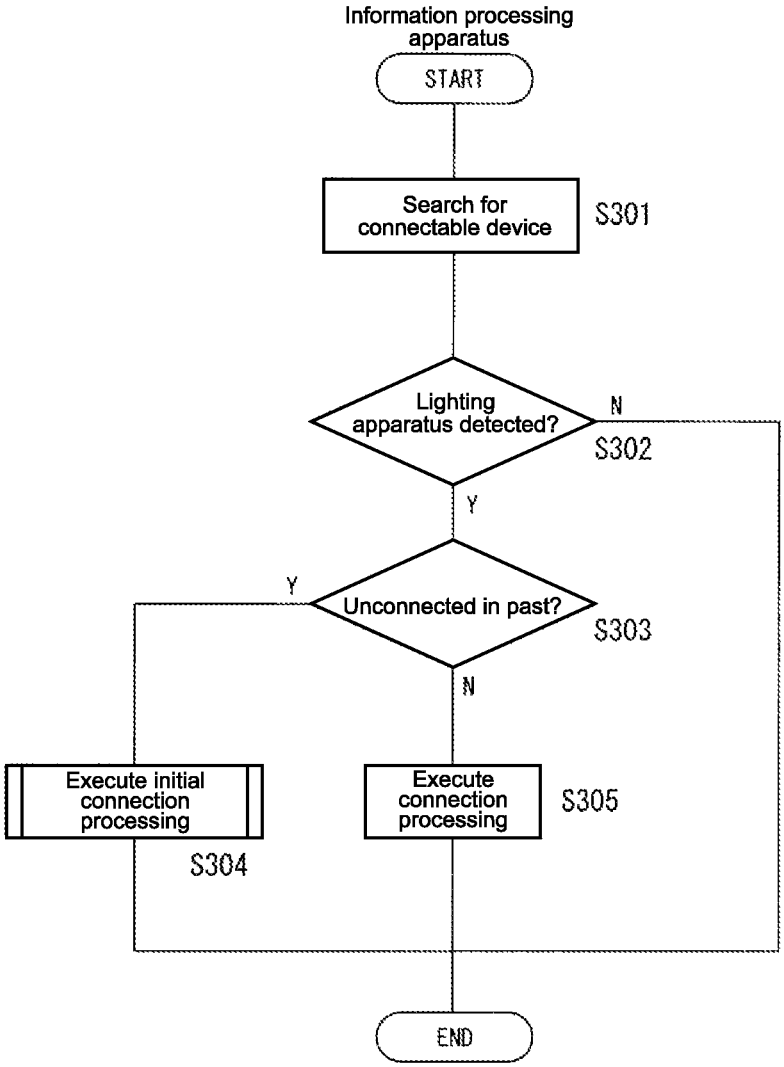
FIG. 7 is a flowchart showing processing executed in the information processing apparatus in order to establish a wireless data communication connection with the lighting apparatus.

FIG. 7 shows a flowchart of processing executed by the information processing apparatus 50 (CPU 51) in order to establish a wireless data communication connection with the lighting apparatus 2'.

Here, processing for establishing a Wi-Fi communication connection will be described first.

The CPU 51 first performs processing for searching for a connectable device in Step S301. In other words, the CPU 51 performs processing for searching for a device with which the Wi-Fi communication unit 59 can communicate.

Subsequently, based on the search result of Step S301, the CPU 51 determines whether the lighting apparatus 2' is detected or not in Step S302. A predetermined SSID (Service Set ID) is set for the Wi-Fi communication unit 27 of the lighting apparatus 2', and the CPU 51 determines whether the SSID is detected or not in Step S302, thus determining whether the lighting apparatus 2' is detected or not.

When the predetermined SSID is not detected and a negative result representing that the lighting apparatus 2' is not detected is obtained, the CPU 51 terminates the processing.

Meanwhile, when the predetermined SSID is detected and a positive result representing that the lighting apparatus 2' is detected is obtained, the CPU 51 proceeds to Step S303 and determines whether the information processing apparatus 50 was unconnected to the lighting apparatus 2' in the past or not, in other words, whether there is a history of a Wi-Fi connection established with the lighting apparatus 2' in the past.

When a positive result representing that the information processing apparatus 50 was unconnected to the lighting apparatus 2' in the past is obtained, the CPU 51 proceeds to Step S304 and executes initial connection processing. Specifically, the CPU 51 executes processing of, for example, displaying a predetermined input screen on the display unit 57A and causes a user to input a security key (encryption key) corresponding to the detected SSID and the Wi-Fi communication unit 59 to transmit the input security key to the lighting apparatus 2'. When the input security key is correct, a Wi-Fi connection with the lighting apparatus 2' is established. In response to this, the processing is terminated. It should be noted that when the input security key is wrong, a connection is not established and thus the CPU 51 executes predetermined processing of causing the user to input the security key again, for example.

Alternatively, when a negative result representing that a connection was established in the past is obtained in Step S303, the CPU 51 proceeds to Step S305 and executes connection processing. In other words, since the correct security key corresponding to the lighting apparatus 2' was input in the past when a connection was established in the past, the CPU 51 causes the Wi-Fi communication unit 59 to transmit the security key to the lighting apparatus 2' to establish the connection. Upon establishing the connection, the CPU 51 terminates the processing.

Regarding the Bluetooth connection by the wireless communication units 28 and 60, a connection is established (that is, pairing is performed) in substantially the same procedure as in the Wi-Fi connection establishment described above except that device model information is used as the SSID and password information such as a four-digit number is used as the security key, for example.

The processing for the establishment of the Wi-Fi connection described with reference to FIG. 7 is executed in accordance with an instruction given by the user via the input unit 56. Alternatively, such processing can be executed by a predetermined cycle of every several minutes.

Figure 8:
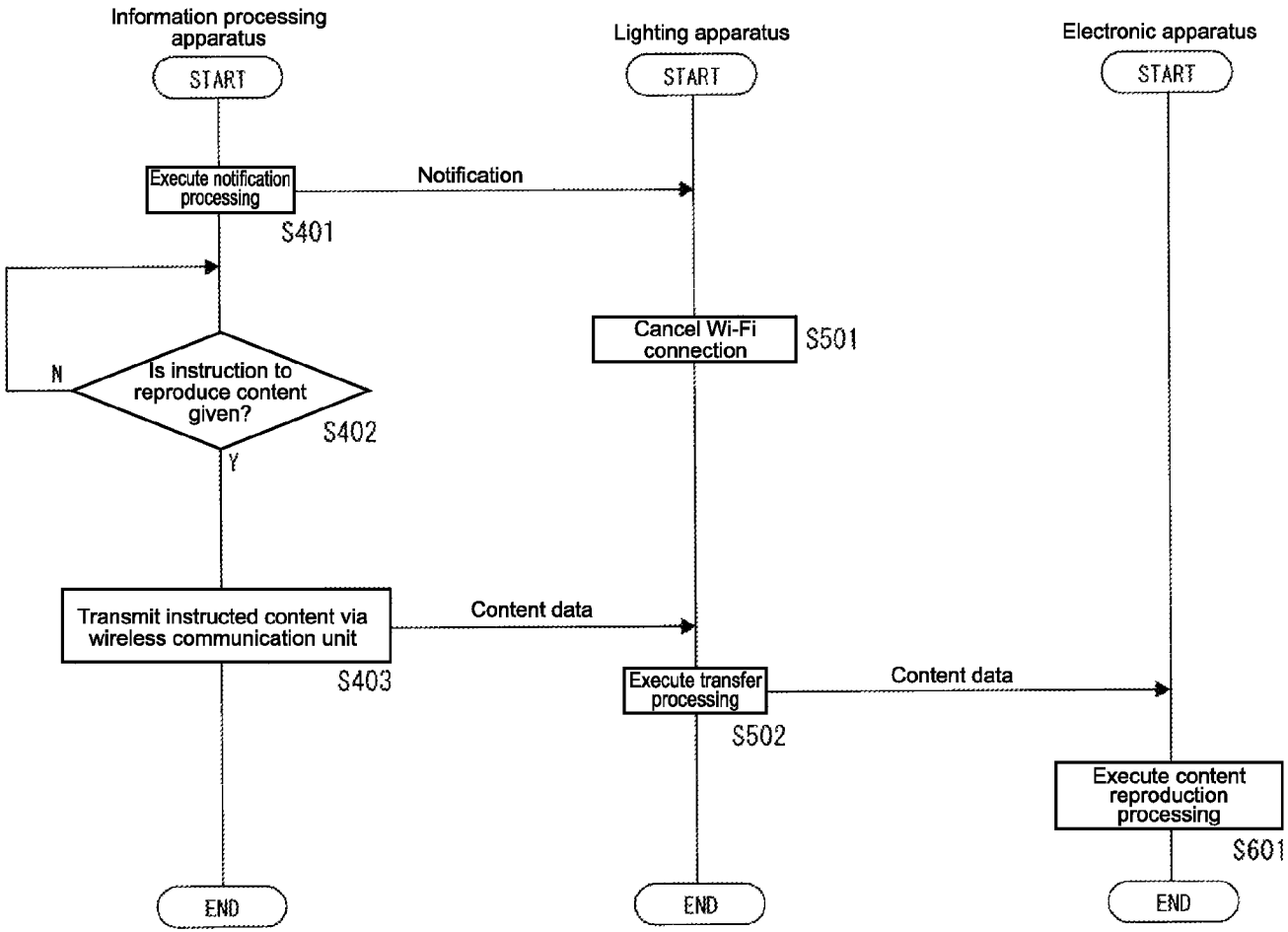
FIG. 8 is a flowchart showing processing executed in the information processing apparatus, the lighting apparatus, and the electronic apparatus to correspond to a case where a sound reproduction apparatus is used as the electronic apparatus.
Figure 9:
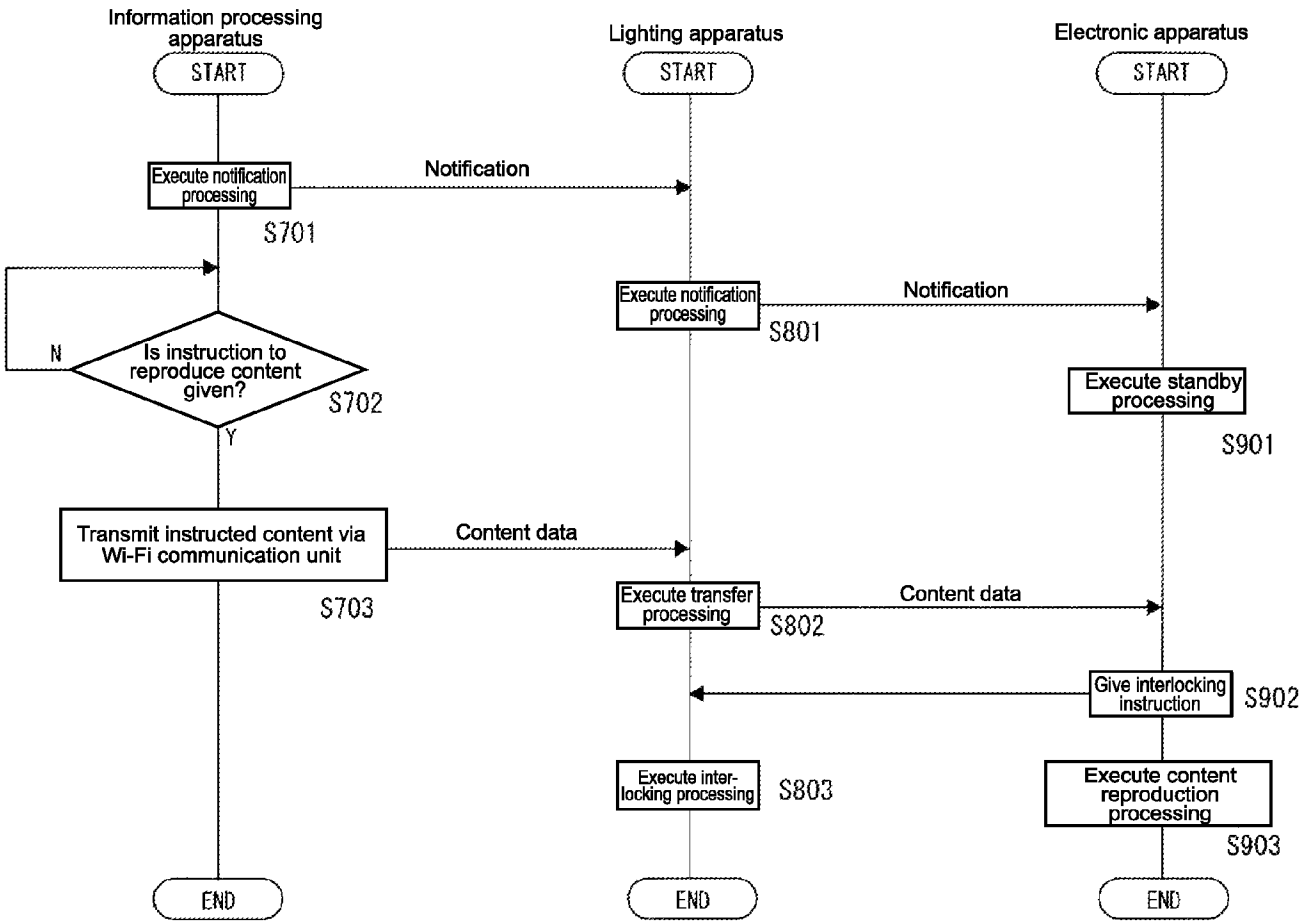
FIG. 9 is a flowchart showing processing executed in the information processing apparatus, the lighting apparatus, and the electronic apparatus to correspond to a case where a projector apparatus is used as the electronic apparatus.
Figure 10:
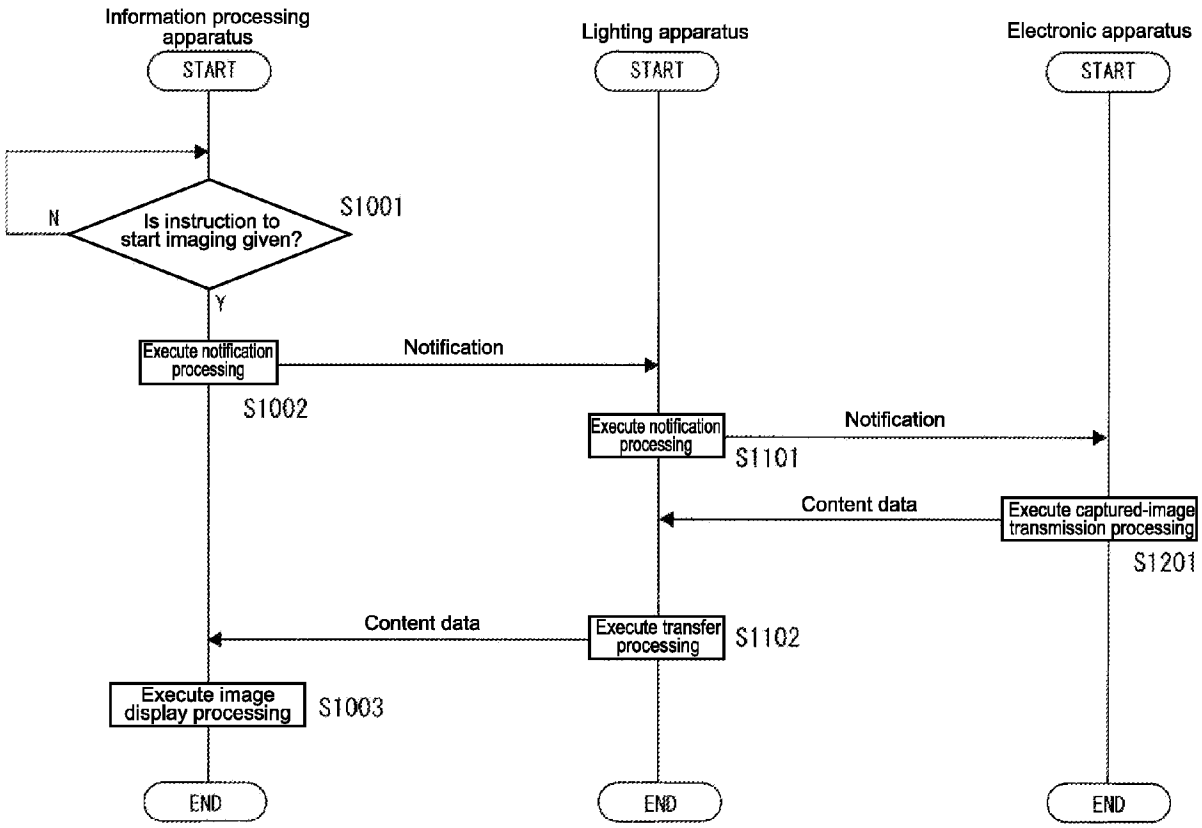
FIG. 10 is a flowchart showing processing executed in the information processing apparatus, the lighting apparatus, and the electronic apparatus to correspond to a case where a camera apparatus is used as the electronic apparatus.

FIGS. 8 to 10 are flowcharts each showing processing executed in the information processing apparatus 50, the lighting apparatus 2', and the electronic apparatus 4 to correspond to a case where each of a sound reproduction apparatus, a projector apparatus, and a camera apparatus is used as the electronic apparatus 4.

In FIGS. 8 to 10, processing of the "lighting apparatus" is executed by the lighting-side microcomputer 24 of the lighting apparatus 2' based on a program stored in its ROM. Further, processing of the "information processing apparatus" is executed by the CPU 51 based on a program serving as the application program 58B. Furthermore, in the case of FIG. 8, processing of the "electronic apparatus" is executed by the apparatus-side microcomputer 42 of the electronic apparatus 4 as the sound reproduction apparatus, in the case of FIG. 9, processing of the "electronic apparatus" is executed by the apparatus-side microcomputer 42 of the electronic apparatus 4 as the projector apparatus, and in the case of FIG. 10, processing of the "electronic apparatus" is executed by the apparatus-side microcomputer 42 of the electronic apparatus 4 as the camera apparatus, based on respective programs stored in the ROM.

At the time of start of the processing shown in FIGS. 8 to 10, it is assumed that a corresponding type of electronic apparatus 4 is already mounted to the lighting apparatus 2' and a wireless communication connection (both of Wi-Fi and Bluetooth) between the lighting apparatus 2' and the information processing apparatus 50 is established.

Further, when the processing shown in FIG. 8 is started, the application program for a sound reproduction apparatus is already activated in the information processing apparatus 50. Similarly, when the processing shown in FIGS. 9 and 10 are started, the application program for a projector apparatus and the application program for a camera apparatus are activated.

First, in FIG. 8, the CPU 51 of the information processing apparatus 50 executes notification processing to the lighting apparatus 2' in Step S401. As the notification processing in Step S401, the CPU 51 notifies the lighting-side microcomputer 24 of the fact that the application program for a sound reproduction apparatus is activated. Further, the CPU 51 also instructs the lighting-side microcomputer 24 to cancel the Wi-Fi connection.

In the lighting apparatus 2', in response to the instruction given in Step S401, processing for canceling the Wi-Fi connection is executed in Step S501. In other words, the Wi-Fi communication unit 27 is instructed to cancel the connection established with the information processing apparatus 50.

This limits a unit for wireless communication with the information processing apparatus 50 to a wireless communication unit other than Wi-Fi (in this example, Bluetooth). In other words, the information processing apparatus 50 is set in a state of being accessible to the Internet via the above-mentioned wireless LAN router. This assumes various use applications such as performing web surfing (browsing web pages) when sound content is reproduced.

In the information processing apparatus 50, when the notification processing is executed in Step S401, the CPU 51 waits until an instruction to reproduce the content is given in Step S402. In other words, the CPU 51 waits until an instruction to reproduce the audio data as the content data 58A stored in the storage unit 58 is given.

Subsequently, when the instruction to reproduce the audio data is given, the CPU 51 executes processing of transmitting the instructed content to the lighting apparatus 2' via the wireless communication unit 60 in Step S403. In other words, the CPU 51 reads out the audio data, which is instructed for reproduction, from the storage unit 58 and also transmits the read-out audio data to the lighting apparatus 2' via the wireless communication unit 60. In response to the execution of the transmission processing in Step S403, the CPU 51 terminates the processing.

In the lighting apparatus 2', in response to the reception of the audio data transmitted from the information processing apparatus 50, transfer processing to the electronic apparatus 4 is executed in Step S502, and the processing is terminated. The transfer processing is processing of transmitting the audio data received by the wireless communication unit 28 to the apparatus-side microcomputer 42 via the data communication terminal Tts.

In the electronic apparatus 4, in response to the reception of the audio data transferred from the lighting apparatus 2', reproduction processing is executed in Step S601 and the processing is terminated. The reproduction processing is processing of decoding the received audio data and outputting the resultant data to the A/D converter 43A.

Through the processing as described above, the sound content instructed for reproduction by the information processing apparatus 50 is reproduced and output by the electronic apparatus 4 as the sound reproduction apparatus mounted to the lighting apparatus 2'.

Further, to support the case where the sound content is reproduced, the content data is transmitted from the information processing apparatus 50 to the lighting apparatus 2' by communication according to wireless communication standards other than the Wi-Fi.

Subsequently, the case of the projector apparatus will be described.

In FIG. 9, the CPU 51 executes notification processing in Step S701. The notification processing in Step S701 is processing for notifying the lighting-side microcomputer 24 and the apparatus-side microcomputer 42 of the activation of the application program for a projector apparatus. Specifically, the CPU 51 transmits an activation notification to the lighting-side microcomputer 24, the activation notification representing that the application is activated, and gives an instruction to transfer the activation notification to the apparatus-side microcomputer 42.

In response to the instruction given in Step S701, the lighting apparatus 2' transfers the activation notification ("notification processing" in FIG. 9) to the apparatus-side microcomputer 42 in Step S801.

In response to the notification transferred from the lighting apparatus 2' in Step S801, the electronic apparatus 4 executes standby processing in Step S901. The standby processing is processing for activating the apparatus function unit 43 to enter a state where an image can be displayed. Specifically, predetermined processing such as turning on the light source unit 43F in the apparatus function unit 43 is executed.

Thus, in response to the activation of the application program for a projector apparatus, the apparatus function unit 43 of the electronic apparatus 4 serving as the projector apparatus enters a standby state.

Upon execution of the notification processing in Step S701 in the information processing apparatus 50, the CPU 51 waits until an instruction to reproduce the content is given in Step S702. In other words, the CPU 51 waits until an instruction to reproduce the image data stored as the content data 58A in the storage unit 58 is given. Here, the image data is moving image data.

When an instruction to reproduce the image data is given, the CPU 51 executes processing of transmitting the instructed content to the lighting apparatus 2' via the Wi-Fi communication unit 59 in Step S703. In other words, the CPU 51 reads out the image data, which is instructed for reproduction, from the storage unit 58 and also transmits the read-out image data to the lighting apparatus 2' via the Wi-Fi communication unit 59. In response to the execution of the transmission processing in Step S703, the CPU 51 terminates the processing.

It should be noted that the image data (moving image data) is transmitted via Wi-Fi, because the transmission via Wi-Fi is more advantageous in terms of a transmission rate than the transmission via Bluetooth. However, if the communication standard of the wireless communication unit 60 has a transmission rate equal to or larger than that of Wi-Fi, the image data can be transmitted via the wireless communication unit 60.

In the lighting apparatus 2', in response to the reception of the image data transmitted from the information processing apparatus 50, transfer processing to the electronic apparatus 4 is executed in Step S802, and the processing is terminated. The transfer processing is processing of transmitting the image data received by the Wi-Fi communication unit 27 to the apparatus-side microcomputer 42 via the data communication terminal Tts.

In the electronic apparatus 4, in response to the reception of the image data transferred from the lighting apparatus 2', an instruction of interlocking with the lighting apparatus 2' is given in Step S902.

The interlocking instruction is an instruction for controlling a light-emitting operation of the light-emitting unit 22 in accordance with the operating state of the electronic apparatus 4. As the interlocking instruction in this case, an instruction to reduce light of the light-emitting unit 22 (or turn off the light-emitting unit 22) is given.

In the lighting apparatus 2', in response to the interlocking instruction from the electronic apparatus 4, interlocking processing is executed in Step S803. Specifically, in accordance with the interlocking instruction, the light emission drive unit 21 is instructed to reduce light of the light-emitting unit 22 (or turn off the light-emitting unit 22).

In such a manner, the interlocking processing of reducing the light of the light-emitting unit 22 is executed, and thus a room environment suitable for viewing the image content by using the projector apparatus can be provided to the user.

In the electronic apparatus 4, the interlocking instruction is given to the lighting apparatus 2' in Step S902, the reproduction processing is subsequently executed in Step S903, and then terminates the processing. The reproduction processing in this case is processing of decoding the received image data and outputs it to the display control unit 43D, to display an image based on the image data on the display panel 43G.

Through the processing as described above, the image content instructed for reproduction by the information processing apparatus 50 is reproduced and output by the electronic apparatus 4 as the projector apparatus mounted to the lighting apparatus 2'.

Subsequently, the case of the camera apparatus will be described.

In FIG. 10, the CPU 51 waits until an instruction to start imaging is given in Step S1001. In other words, the CPU 51 waits until an instruction to start imaging is given by a user via the input unit 56.

When an instruction to start imaging is given, the CPU 51 executes notification processing in Step S1002. The notification processing in Step S1002 is processing for notifying the lighting-side microcomputer 24 and the apparatus-side microcomputer 42 of the generation of the instruction to start imaging. Specifically, the CPU 51 transmits an imaging start notification to the lighting-side microcomputer 24, the imaging start notification representing that an instruction to start imaging is given, and gives an instruction to transfer the imaging start notification to the apparatus-side microcomputer 42.

In response to the instruction given in Step S1002, the lighting apparatus 2' transfers the imaging start notification ("notification processing" in FIG. 10) to the apparatus-side microcomputer 42 in Step S1101.

In response to the notification transferred from the lighting apparatus 2' in Step S1101, the electronic apparatus 4 executes captured-image transmission processing in Step S1201. In other words, processing of executing a generation of captured image data by the imaging unit 43H and a generation of image data (compressed image data) based on the captured image data by the image processing unit 43I and processing of transmitting the generated image data to the lighting-side microcomputer 24 via the data communication terminal Ttk are executed.

In the lighting apparatus 2', in response to the reception of the image data from the electronic apparatus 4, transfer processing is executed in Step S1102, and the processing is terminated. The transfer processing is processing of transmitting the received image data to the information processing apparatus 50. In the transfer processing, the image data is transmitted to the information processing apparatus 50 via the Wi-Fi communication unit 27.

In the information processing apparatus 50, in response to the reception of the image data from the lighting apparatus 2', image display processing is executed in Step S1003 and the processing is terminated. The image display processing is processing of decoding the image data received by the Wi-Fi communication unit 59 and displaying the image data on the display unit 57A.

Through the processing as described above, the image content acquired by the electronic apparatus 4 serving as the camera apparatus mounted to the lighting apparatus 2' is reproduced and output in the information processing apparatus 50.

It should be noted that in the above description, the interlocking processing is executed only when the electronic apparatus 4 serving as the projector apparatus is mounted, but the interlocking processing can be executed also when a different type of electronic apparatus 4 is mounted. For example, in the case of the sound reproduction apparatus, it is possible to perform control such as performing dimming control of the light-emitting unit 22 in accordance with a melody of sound content to be reproduced. Further, in the case of the camera apparatus, it is possible to perform control such as increasing the amount of emitted light of the light-emitting unit 22 in response to the start of imaging, in order to secure sufficient brightness for imaging.

(2-3. Conclusion of Second Embodiment)

As described above, in the second embodiment, the lighting apparatus 2' includes the communication units for performing the data communication with the information processing apparatus 50.

This allows an achievement of a lighting system that executes an operation interlocking with the information processing apparatus 50.

Further, in the second embodiment, the apparatus function unit 43 has the content data reproduction and output function or the content data acquisition function, and the lighting-side microcomputer 24 executes any of the processing of transferring the content data, which is received by the communication units from the information processing apparatus 50, to the electronic apparatus 4 and the processing of transferring the content data, which is received from the electronic apparatus 4, to the information processing apparatus 50 via the communication units.

Thus, the content data stored by the information processing apparatus 50 can be reproduced and output by the electronic apparatus 4, or the content data acquired by the electronic apparatus 4 can be reproduced and output by the information processing apparatus 50. This can provide an innovative and novel way of using the lighting system.

Additionally, in the second embodiment, the communication units are configured to be capable of communicating by Wi-Fi and wireless communication standards other than Wi-Fi. In the case where the content data is sound data, the lighting-side microcomputer 24 causes the communication unit to execute the communication by wireless communication standards other than Wi-Fi.

Thus, in the case where the sound content is reproduced and output, the information processing apparatus 50 is capable of being connectable to the Internet via Wi-Fi. This allows an achievement of a use application of browsing web pages while listening to the sound content.

Furthermore, in the second embodiment, the lighting-side microcomputer 24 controls the light-emitting operation of the light-emitting unit 22 in accordance with the operating state of the mounted electronic apparatus 4.

In such a manner, the light-emitting operation of the light-emitting unit 22 is controlled by interlocking with the operating state of the electronic apparatus 4, and thus it is possible to obtain effects of sufficiently exerting the function of the electronic apparatus 4 and increasing entertainment performance.

It should be noted that in this example, the program executed by the lighting-side microcomputer 24 is not prepared for each type of electronic apparatus 4 to be mounted, and only one program corresponding to all types of electronic apparatuses 4 is stored. This means that the application program 58B and the program of the electronic apparatus 4 are designed based on the program of the lighting apparatus 2'.

This can avoid rewriting the program of the lighting apparatus 2' when a new type of electronic apparatus is added as a corresponding apparatus of the lighting system or when an apparatus that has the same type but is additionally provided with a new function due to an improvement of performance is added as a corresponding apparatus.

3. Modified Examples

It should be noted that the present disclosure is not limited to the specific examples described above and various modified examples are conceived.

Hereinafter, the modified examples will be described.

(3-1. Modified Example 1)

The modified example 1 is a modified example related to a requested voltage level of the apparatus function unit 43.

In the above description, the electronic apparatus 4 includes the voltage transformer circuit 41 and thus a DC voltage at an appropriate level is supplied to the apparatus function unit 43. In the modified example 1, however, a DC voltage at an appropriate level corresponding to the mounted electronic apparatus 4 is generated on the lighting apparatus side, so that the voltage transformer circuit 41 of the electronic apparatus 4 can be eliminated.

Figure 11:
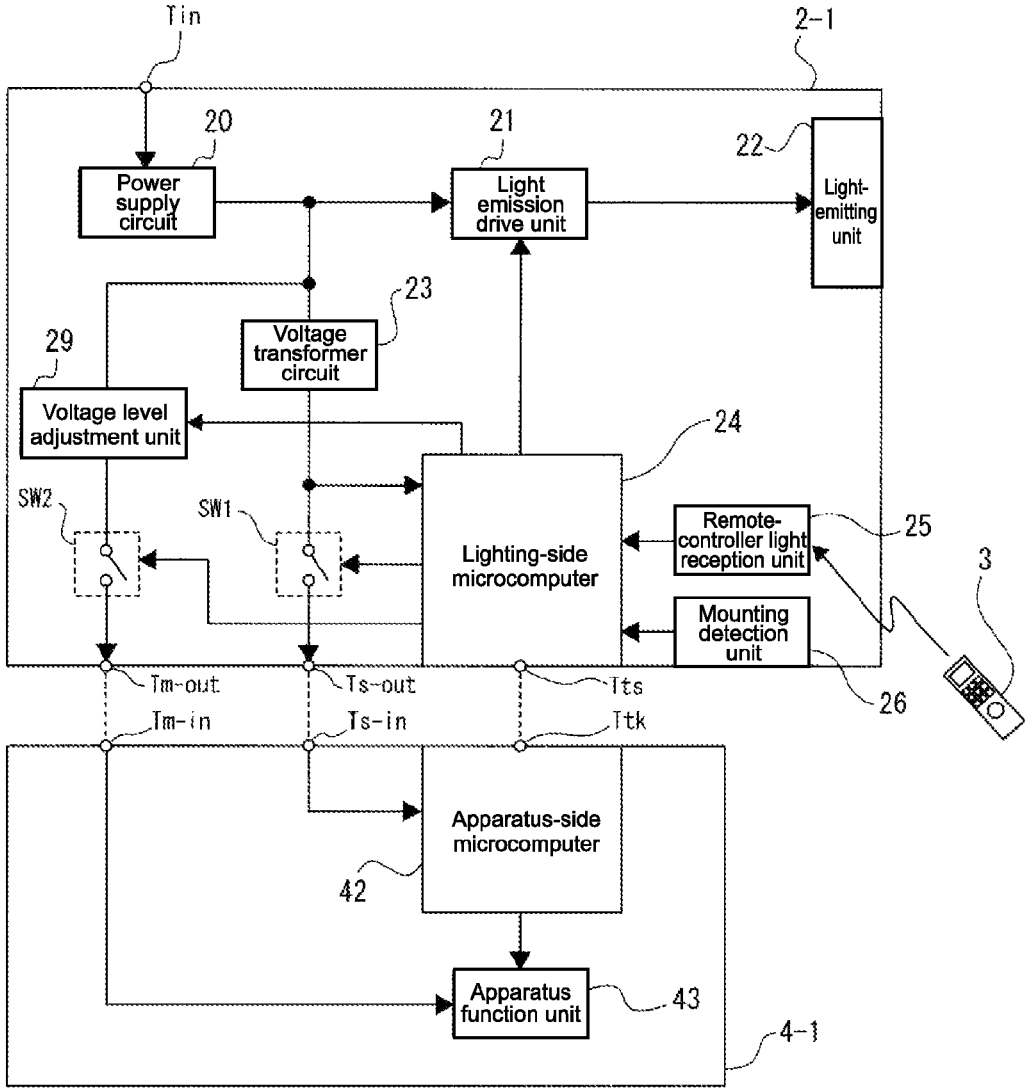
FIG. 11 is an explanatory diagram showing a configuration of a lighting system as a modified example 1.

FIG. 11 is an explanatory diagram showing a configuration of a lighting system 6 as the modified example 1.

In the lighting system 6, a lighting apparatus 2-1 is provided instead of the lighting apparatus 2, and an electronic apparatus 4-1 is provided instead of the electronic apparatus 4. The lighting apparatus 2-1 is different from the lighting apparatus 2 in that a DC voltage generated in a power supply circuit 20 is supplied to a switch SW2 via a voltage level adjustment unit 29. Further, the electronic apparatus 4-1 is different from the electronic apparatus 4 in that a voltage transformer circuit 41 is eliminated and an input voltage from a power input terminal Tm-in is supplied to an apparatus function unit 43.

The voltage level adjustment unit 29 of the lighting apparatus 2-1 transforms the DC voltage, which is supplied from the power supply circuit 20, to have a level corresponding to an instruction from a lighting-side microcomputer 24 and outputs the transformed DC voltage.

Figure 12:
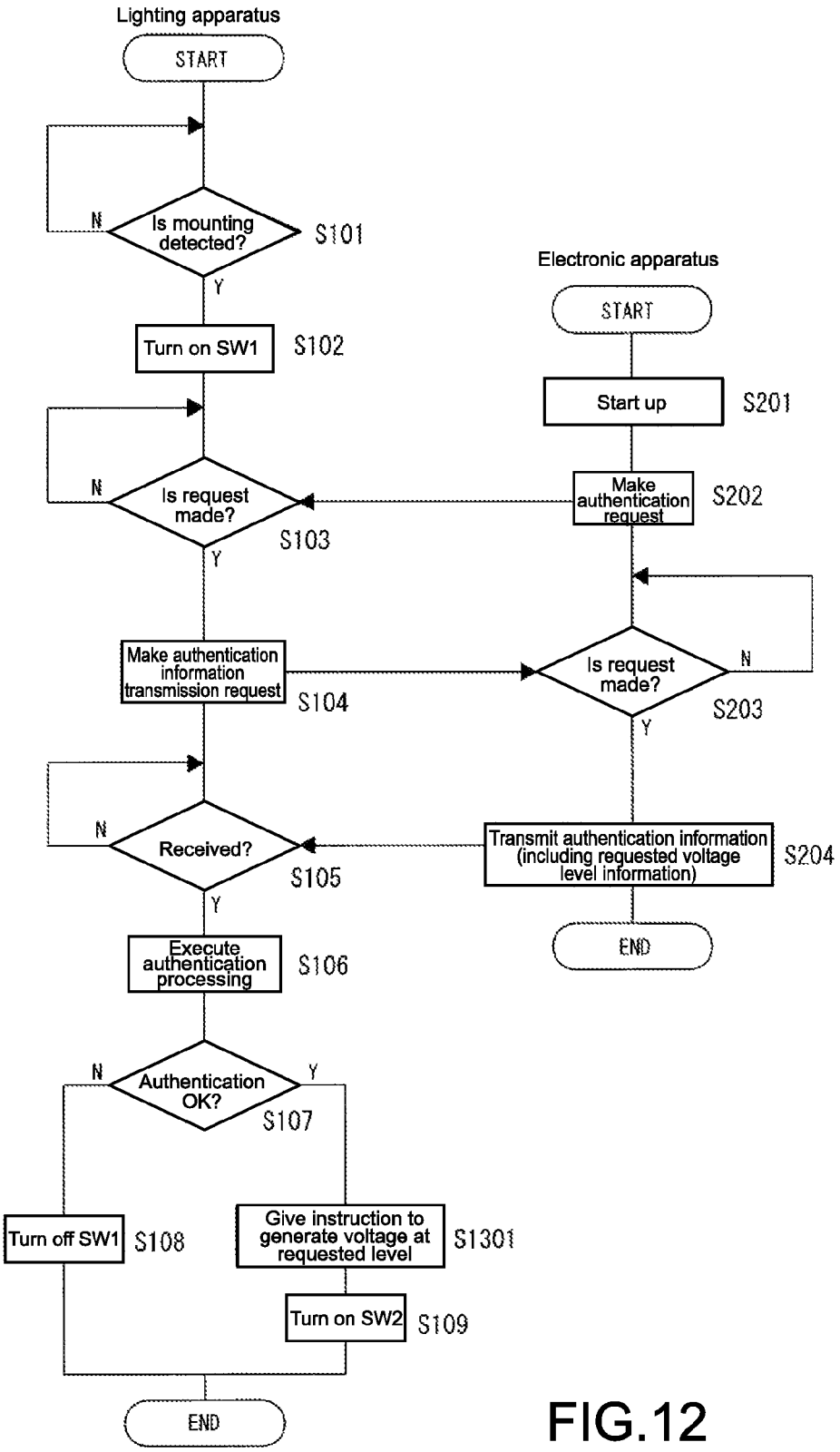
FIG. 12 is a flowchart for describing processing executed in the lighting system as the modified example 1.

FIG. 12 is a flowchart for describing processing executed in the lighting system 6 as the modified example 1. Processing of the "lighting apparatus" is processing executed by the lighting-side microcomputer 24 of the lighting apparatus 2-1 based on a program stored in its ROM, and processing of the "electronic apparatus" is processing executed by an apparatus-side microcomputer 42 of the electronic apparatus 4-1 based on a program stored in its ROM.

It should be noted that in the following description, the same processing as that already described are denoted by the same step numbers and their descriptions are omitted, and only differences from the first embodiment will be mainly described.

As shown in FIG. 12, the lighting apparatus 2-1 performs the same processing as those of Steps S101 to S107 above shown in FIG. 3. Further, the electronic apparatus 4-1 also performs the same processing as those of Steps S201 to S204 above shown in FIG. 3.

However, in the processing of Step S204 in this case, which is executed by the electronic apparatus 4-1, the apparatus-side microcomputer 42 transmits, as authentication information, information on an authentication key and information on a voltage level requested by the apparatus function unit 43. This requested voltage level information is stored in the ROM of the apparatus-side microcomputer 42, for example. The apparatus-side microcomputer 42 reads out the requested voltage level information from the ROM and transmits the information as the authentication information to the lighting apparatus 2-1.

When a positive result representing that the authentication succeeds is obtained in Step S107, the lighting-side microcomputer 24 in this case instructs the voltage level adjustment unit 29 to generate a voltage at a requested level in Step S1301.

With this configuration, when the authentication succeeds, the switch SW2 is turned on in the next Step S109. Thus, the DC voltage at a requested voltage level is supplied to the apparatus function unit 43.

As in the modified example 1, also when the lighting apparatus generates a voltage at a voltage level requested by the apparatus function unit, it is possible to support a case where a requested voltage level of the apparatus function unit differs depending on the type of the electronic apparatus.

According to the modified example 1, the voltage transformer circuit 41 is not used. Thus, the number of components of the electronic apparatus 4-1 can be reduced and the reduction in size and costs of the apparatus can be achieved.

(3-2. Modified Example 2)

The modified example 2 is a modified example related to power supply in the authentication processing.

Figure 13:
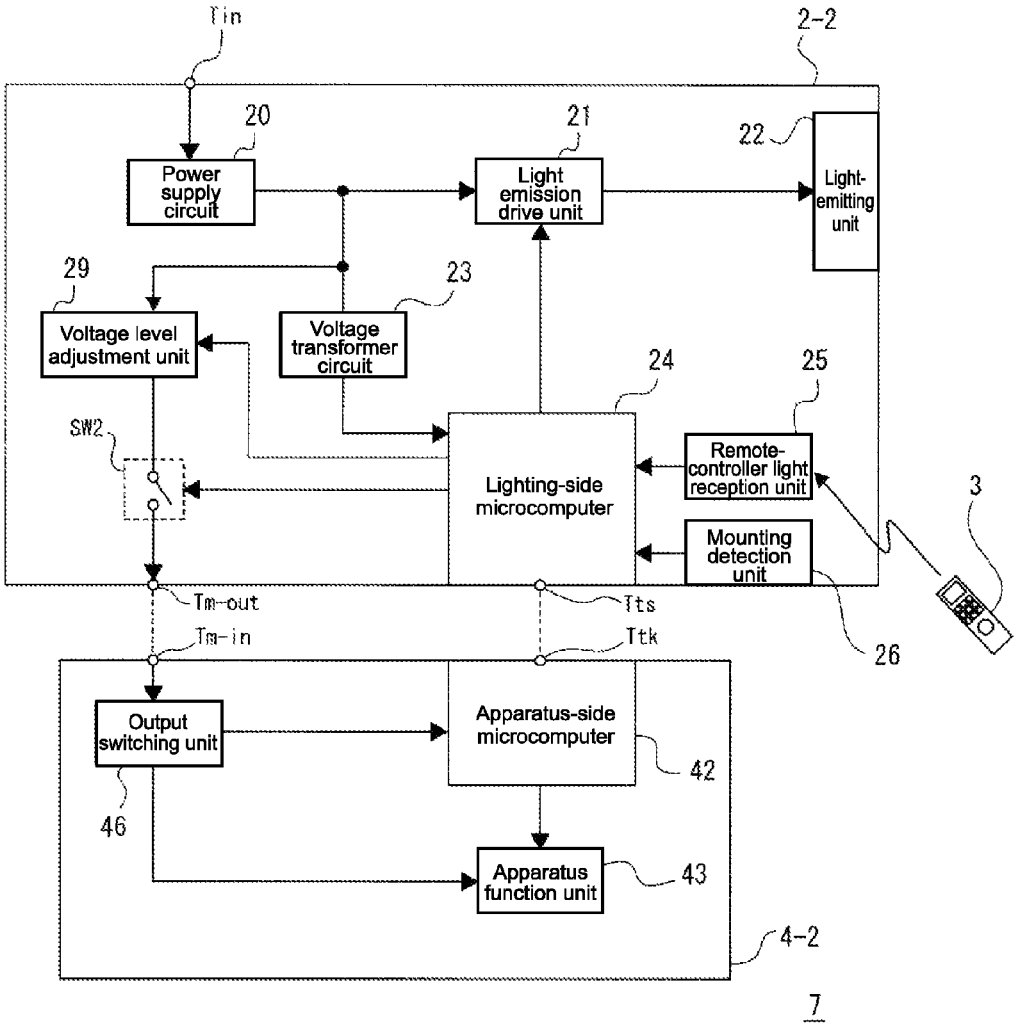
FIG. 13 is an explanatory diagram showing a configuration of a lighting system as a modified example 2.

FIG. 13 is an explanatory diagram showing a configuration of a lighting system 7 as the modified example 2.

In the lighting system 7, a lighting apparatus 2-2 is provided instead of the lighting apparatus 2, and an electronic apparatus 4-2 is provided instead of the electronic apparatus 4. The lighting apparatus 2-2 is different from the lighting apparatus 2 in that a DC voltage generated in a power supply circuit 20 is supplied to a switch SW2 via a voltage level adjustment unit 29 and that a switch SW1 and a power output terminal Ts-out are eliminated. Further, the electronic apparatus 4-2 is different from the electronic apparatus 4 in that an output switching unit 46 is provided instead of the voltage transformer circuit 41 and that a power input terminal Ts-in is eliminated.

The output switching unit 46 of the electronic apparatus 4-2 switches an output destination of an input voltage in accordance with a level of the input voltage from a power input terminal Tm-in. Specifically, when the input voltage has a first level, the output switching unit 46 outputs the input voltage to the apparatus-side microcomputer 42, and when the input voltage has a second level, the output switching unit 46 outputs a DC voltage at the first level to the apparatus-side microcomputer 42 and also outputs a DC voltage at the second level to the apparatus function unit 43, the DC voltage being generated based on the input voltage.

Here, the first level is a requested voltage level of the apparatus-side microcomputer 42, and the second level is a requested voltage level of the apparatus function unit 43.

Figure 14:
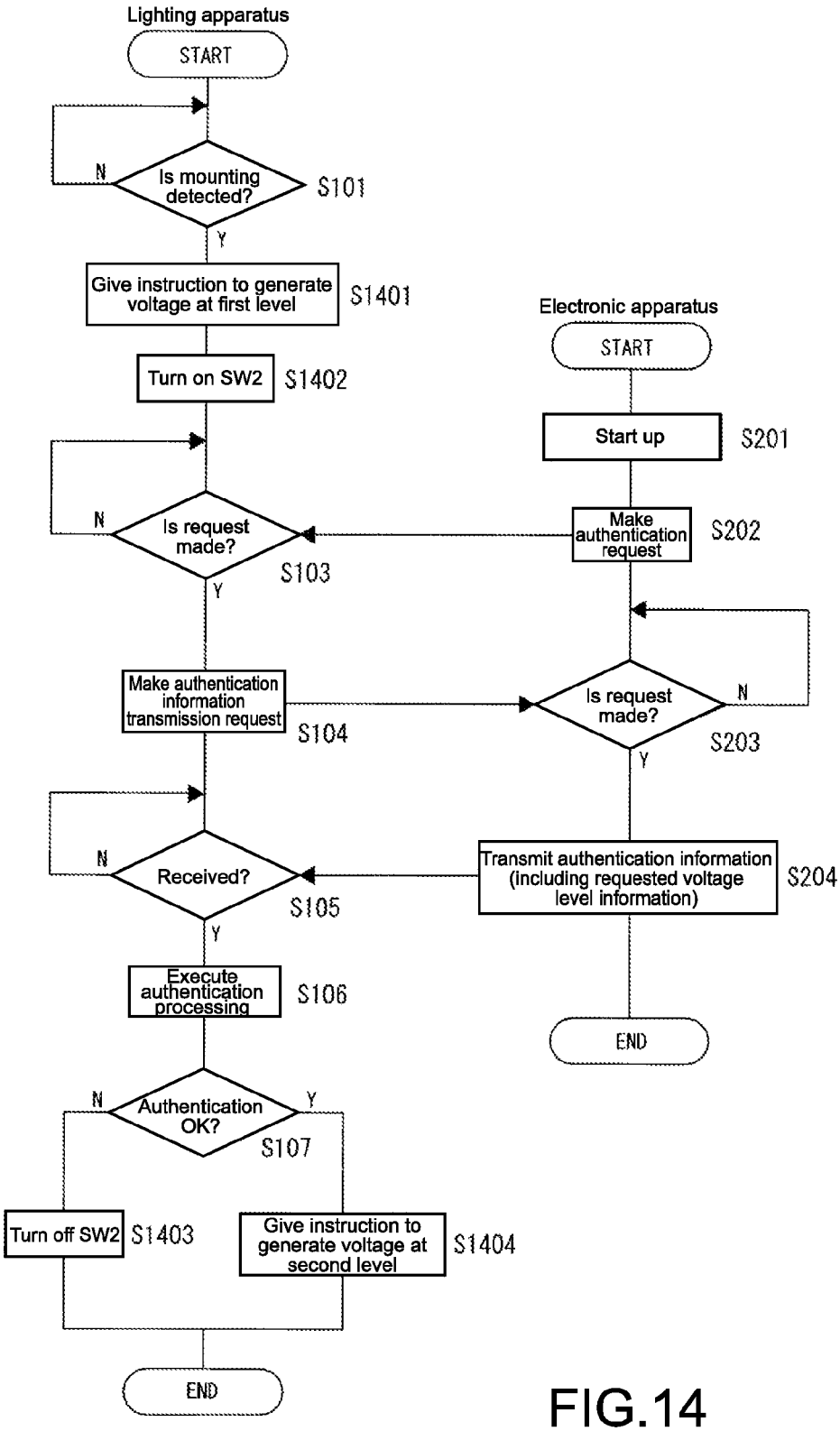
FIG. 14 is a flowchart for describing processing executed in the lighting system as the modified example 2.

FIG. 14 is a flowchart for describing processing executed in the lighting system 7 as the modified example 2.

In response to the mounting of the electronic apparatus 4-2 in Step S101, the lighting-side microcomputer 24 in this case instructs the voltage level adjustment unit 29 to generate a voltage at the first level in Step S1401.

Subsequently, in the next Step S1402, a switch SW2 is turned on. Thus, the DC voltage at the first level that is the requested voltage level of the apparatus-side microcomputer 42 is input to the output switching unit 46 of the electronic apparatus 4-2. In response to this, the DC voltage at the first level is supplied from the output switching unit 46 to the apparatus-side microcomputer 42. In other words, the apparatus-side microcomputer 42 is activated.

The electronic apparatus 4-2 executes the processing of Steps S201 to S204. Also in this case, in the transmission processing of Step S204, the requested voltage level information is also transmitted as the authentication information, as in the modified example 1.

The lighting apparatus 2-2 executes the processing of Steps S103 to S107 in response to the execution of the processing of Step S1402. In this case, when a negative result representing that the authentication fails is obtained in Step S107, the lighting apparatus 2-2 turns off the switch SW2 in Step S1403. Thus, when the authentication fails, the power supply to the electronic apparatus 4-2 is completely shut down.

Meanwhile, when a positive result representing that the authentication succeeds is obtained, the lighting apparatus 2-2 instructs the voltage level adjustment unit 29 to generate a voltage at the second level in Step S1404. Thus, the DC voltage at the second level that is the requested voltage level of the apparatus function unit 43 is input to the output switching unit 46 of the electronic apparatus 4-2. In response to this, the DC voltage at the second level is supplied from the output switching unit 46 to the apparatus function unit 43. In other words, the apparatus function unit 43 enters an operable state.

According to the modified example 2 as well, the operating voltage can be supplied to the apparatus function unit 43 based on the result of the authentication processing.

It should be noted that from this regard, the technique for supplying the operating voltage from the lighting apparatus to the apparatus function unit of the electronic apparatus based on the result of the authentication processing is not limited to that described in the above first embodiment, and various techniques are conceived.

It should be noted that the modified example 2 and the modified example 1 described above are also applicable to the second embodiment.

(3-3. Modified Example 3)

A modified example 3 is a modified example according to the second embodiment.

Figure 15:
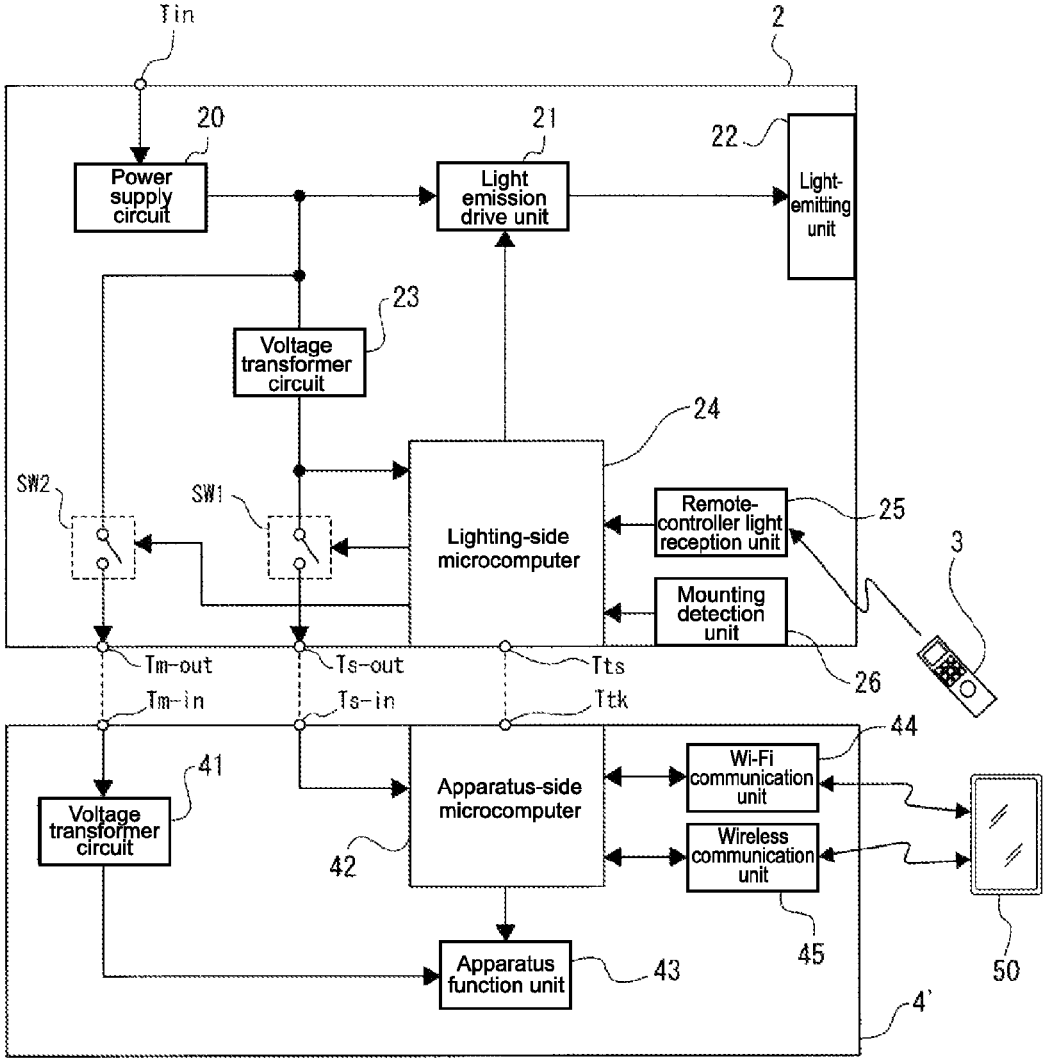
FIG. 15 is an explanatory diagram showing a configuration of a lighting system as a modified example 3.

FIG. 15 is an explanatory diagram showing a configuration of a lighting system 8 as the modified example 3.

The lighting system 8 is different from the lighting system 5 of the second embodiment in that a lighting apparatus 2 and an electronic apparatus 4' are provided instead of the lighting apparatus 2' and the electronic apparatus 4. The lighting apparatus 2 is obtained by eliminating the Wi-Fi communication unit 27 and the wireless communication unit 28 from the lighting apparatus 2'. The electronic apparatus 4' is obtained by additionally providing a Wi-Fi communication unit 44 and a wireless communication unit 45 to the electronic apparatus 4. In other words, wireless data communication with an information processing apparatus 50 is performed by not the lighting apparatus but the electronic apparatus.

Figure 16:
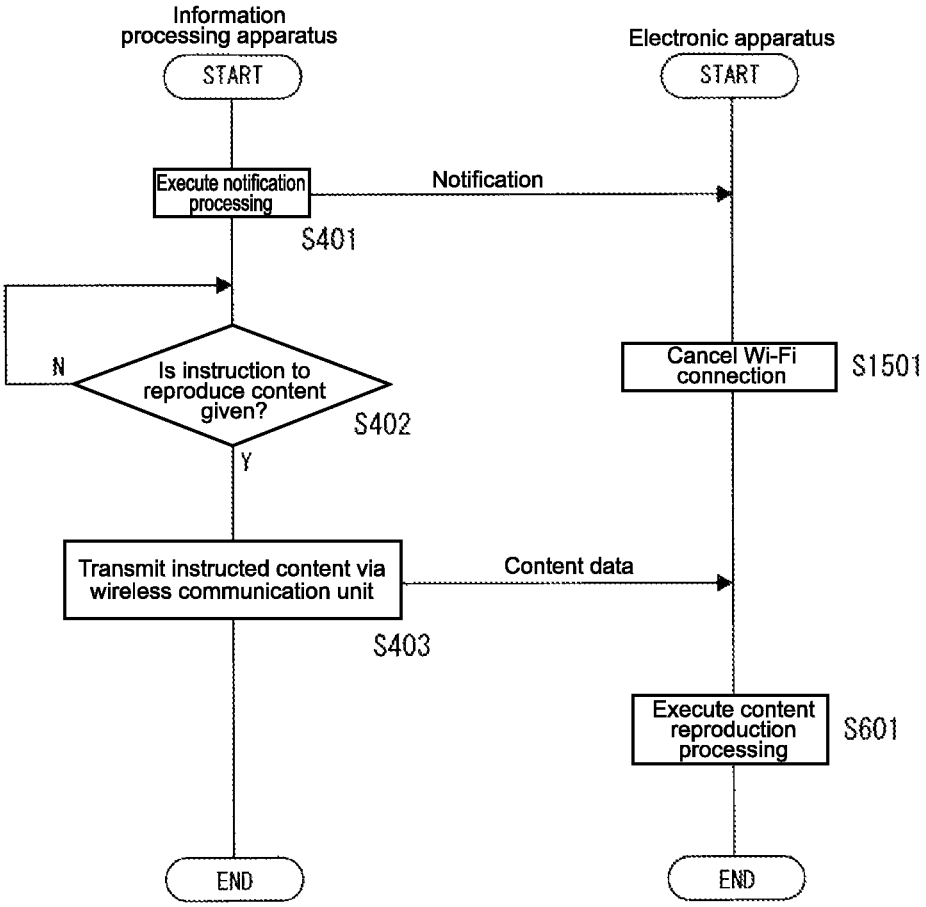
FIG. 16 is a flowchart showing processing executed to correspond to a case where a sound reproduction apparatus is used as an electronic apparatus in the lighting system as the modified example 3.
Figure 17:
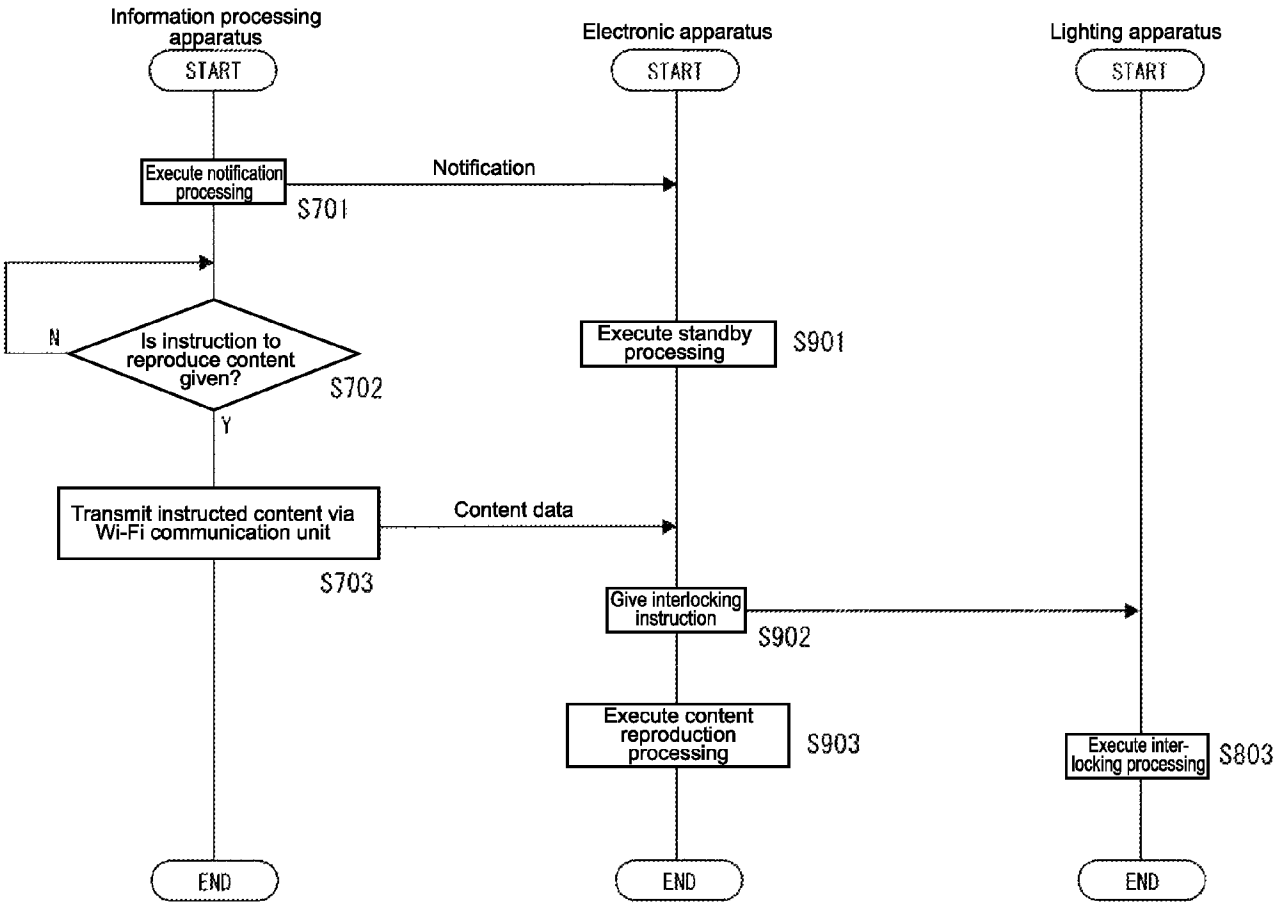
FIG. 17 is a flowchart showing processing executed to correspond to a case where a projector apparatus is used as an electronic apparatus in the lighting system as the modified example 3.
Figure 18:
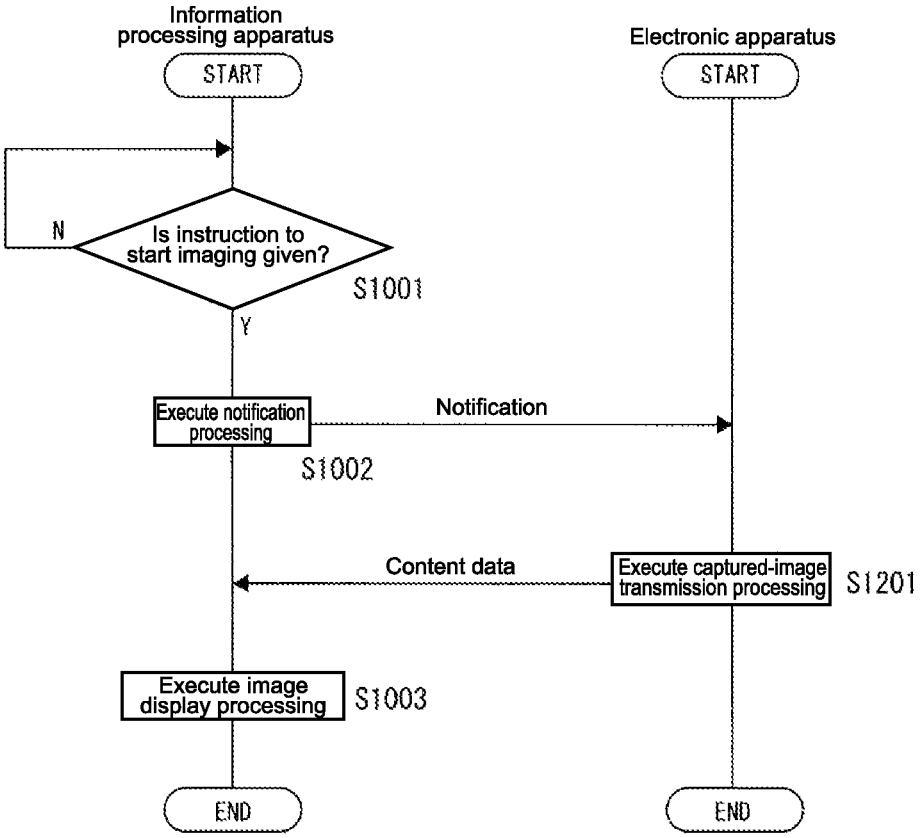
FIG. 18 is a flowchart showing processing executed to correspond to a case where a camera apparatus is used as an electronic apparatus in the lighting system as the modified example 3.

FIGS. 16 to 18 are flowcharts each showing processing executed in the lighting system 8 to correspond to a case where a sound reproduction apparatus, a projector apparatus, and a camera apparatus are each used as the electronic apparatus 4'.

In FIGS. 16 to 18, it is assumed that, as in the cases shown in FIGS. 8 to 10, the electronic apparatus 4' is already mounted to the lighting apparatus 2, a wireless communication connection (both of Wi-Fi and Bluetooth) between the electronic apparatus 4' and the information processing apparatus 50 is established, and an application program corresponding to a type of the electronic apparatus 4' is activated in the information processing apparatus 50.

As shown in FIGS. 16 to 18, in any case of the sound reproduction apparatus, the projector apparatus, and the camera apparatus, processing by the information processing apparatus 50 are the same as the processing shown in FIGS. 8 to 10. In this case, however, a transmission destination of a notification, an instruction, and data is the electronic apparatus 4' (the Wi-Fi communication unit 44 and the wireless communication unit 45).

In the case of the sound reproduction apparatus shown in FIG. 16, in response to a notification from the information processing apparatus 50 (S401: application program activation notification), the electronic apparatus 4' executes processing of cancelling a Wi-Fi connection in Step S1501. In other words, the electronic apparatus 4' instructs the Wi-Fi communication unit 44 to cancel the connection established with the information processing apparatus 50.

Further, in response to the reception of audio data by the wireless communication unit 45, the audio data being transmitted from the information processing apparatus 50 via the wireless communication unit 60, the electronic apparatus 4' executes reproduction processing of the received content in Step S601.

In the case of the projector apparatus shown in FIG. 17, in response to a notification from the information processing apparatus 50 (S701: application program activation notification), the electronic apparatus 4' executes standby processing in Step S901.

Further, in response to the reception of image data by the Wi-Fi communication unit 44, the image data being transmitted from the information processing apparatus 50 via the Wi-Fi communication unit 59, the electronic apparatus 4' gives an interlocking instruction to the lighting apparatus 2 in Step S902 and execute reproduction processing of the received content in the next Step S903.

In response to the interlocking instruction, the lighting apparatus 2 executes the interlocking processing in Step S803.

In the case of the camera apparatus shown in FIG. 18, in response to a notification from the information processing apparatus 50 (S1002: imaging start notification), the electronic apparatus 4' executes captured-image transmission processing in Step S1201. It should be noted that the captured-image transmission processing in this case is processing of transmitting compressed image data, which is acquired by the image processing unit 43I, to the information processing apparatus 50 via the Wi-Fi communication unit 44.

According to the above-mentioned modified example 3 as well, the same effects as those produced in the second embodiment are obtained.

(3-4. Other Modified Examples)

In the above description, the sound reproduction apparatus, the projector apparatus, the camera apparatus, and the like are exemplified as the electronic apparatus, but those apparatuses are merely examples and the electronic apparatus according to the embodiments of the present disclosure are not limited to those apparatuses.

As the electronic apparatus according to an embodiment of the present disclosure, an electronic apparatus that can exert its function more by being attached to the vicinity of a ceiling is suitably adopted.

Further, the case where the data communication between the lighting-side microcomputer 24 and the apparatus-side microcomputer 42 is performed by wired communication is exemplified, but the data communication can be wirelessly performed.

At that time, the wireless data communication between the lighting-side microcomputer 24 and the apparatus-side microcomputer 42 can be performed by NFC (Near Field Communication).

Further, the power supply for authentication from the lighting apparatus 2 to the apparatus-side microcomputer 42 can also be performed by not a wired manner but a wireless manner. For example, the above-mentioned NFC technology allows the power supply and data communication for the authentication processing to be performed in a non-contact manner.

Furthermore, in the examples of FIGS. 2, 4, and 11, it is assumed that the operating voltage at the same level is supplied to the lighting-side microcomputer 24 and the apparatus-side microcomputer 42, but the operating voltage may differ. In this regard, a voltage transformer circuit can also be provided between the switch SW1 and the power output terminal Ts-out or between the apparatus-side microcomputer 42 and the power input terminal Ts-in.

Moreover, the interlocking processing is also not limited to the examples described above. For example, in the case of an ion generator or a fire alarm notification appliance, control such as causing the light-emitting unit 22 to emit light in a predetermined blinking pattern in response to an operation start or stop of the ion generator or the fire alarm notification appliance can be performed.

In addition, the case where the content reproduced and output by the electronic apparatus is content stored in advance in the information processing apparatus 50 has been exemplified in the second embodiment, but data may be read out from a predetermined server apparatus over the Internet and transferred to the electronic apparatus, like so-called streaming reproduction.

4. Present Disclosure

It should be noted that the present disclosure can have the following configurations.

(1) A lighting apparatus, including:

a power supply circuit;

a light-emitting unit configured to drive light emission based on a power supply voltage generated by the power supply circuit;

a mounting unit configured to detachably mount an electronic apparatus including an apparatus-side controller and an apparatus function unit controlled by the apparatus-side controller; and a lighting-side controller configured to perform control to supply an operating voltage based on the power supply voltage to the apparatus-side controller of the electronic apparatus mounted to the mounting unit to perform authentication processing with the apparatus-side controller, and perform, based on a result of the authentication processing, control to supply the operating voltage based on the power supply voltage to the apparatus function unit.

(2) The lighting apparatus according to (1), in which the mounting unit is configured to be capable of mounting a unit to be mounted that is provided to the electronic apparatus and has a structure common to the electronic apparatus, the electronic apparatus including a plurality of types of electronic apparatuses each including the apparatus function unit having a different function.

(3) The lighting apparatus according to (1) or (2), in which the lighting-side controller is configured to perform, when the authentication processing fails, control to stop power supply to the apparatus-side controller.

(4) The lighting apparatus according to any one of (1) to (3), further including a voltage level adjustment unit configured to transform the power supply voltage generated by the power supply circuit to have a requested voltage level and output the transformed power supply voltage, in which the lighting-side controller is configured to cause the voltage level adjustment unit to generate a voltage at a level corresponding to the electronic apparatus mounted to the mounting unit.

(5) The lighting apparatus according to any one of (1) to (4), in which the lighting-side controller is configured to control a light-emitting operation of the light-emitting unit in accordance with an operating state of the mounted electronic apparatus.

(6) The lighting apparatus according to any one of (1) to (5), further including a communication unit for performing data communication with an information processing apparatus.

(7) The lighting apparatus according to (6), in which the apparatus function unit of the electronic apparatus has one of a content data reproduction and output function and a content data acquisition function, and the lighting-side controller is configured to execute any one of processing of transferring, to the electronic apparatus, content data received by the communication unit from the information processing apparatus and processing of transferring, to the information processing apparatus via the communication unit, content data received from the electronic apparatus.

(8) The lighting apparatus according to (7), in which the communication unit is configured to be capable of performing communication by wireless fidelity (Wi-Fi) and communication by a wireless communication standard other than the Wi-Fi, and the lighting-side controller is configured to cause, when the content data is sound data, the communication unit to execute the communication by the wireless communication standard other than the Wi-Fi.

(9) A lighting system, including:

an electronic apparatus; and a lighting apparatus, the electronic apparatus including an apparatus-side controller, and an apparatus function unit controlled by the apparatus-side controller, the lighting apparatus including a power supply circuit, a light-emitting unit configured to drive light emission based on a power supply voltage generated by the power supply circuit, a mounting unit configured to detachably mount the electronic apparatus, and a lighting-side controller configured to perform control to supply an operating voltage based on the power supply voltage to the apparatus-side controller of the electronic apparatus mounted to the mounting unit to perform authentication processing with the apparatus-side controller, and perform, based on a result of the authentication processing, control to supply the operating voltage based on the power supply voltage to the apparatus function unit.

(10) The lighting system according to (9), in which the mounting unit is configured to be capable of mounting a unit to be mounted that is provided to the electronic apparatus and has a structure common to the electronic apparatus, the electronic apparatus including a plurality of types of electronic apparatuses each including the apparatus function unit having a different function.

(11) The lighting system according to (9) or (10), in which the lighting-side controller is configured to perform, when the authentication processing fails, control to stop power supply to the apparatus-side controller.

(12) The lighting system according to any one of (9) to (11), in which the electronic apparatus includes a voltage transformer circuit configured to transform the operating voltage supplied from the lighting apparatus based on the result of the authentication processing to have a predetermined voltage level and output the transformed operating voltage to the apparatus function unit.

(13) The lighting system according to any one of (9) to (12), in which the lighting-side controller is configured to control a light-emitting operation of the light-emitting unit in accordance with an operating state of the mounted electronic apparatus.

(14) The lighting system according to any one of (9) to (13), further including:

an information processing apparatus; and a communication unit for performing one of data communication between the information processing apparatus and the lighting-side controller and data communication between the information processing apparatus and the apparatus-side controller.

(15) The lighting system according to (14), in which the apparatus function unit of the electronic apparatus has one of a content data reproduction and output function and a content data acquisition function, the communication unit includes a lighting-side communication unit provided to the lighting apparatus, and the lighting-side controller is configured to execute any one of processing of transferring, to the electronic apparatus, content data received by the lighting-side communication unit from the information processing apparatus and processing of transferring, to the information processing apparatus via the lighting-side communication unit, content data received from the electronic apparatus.

(16) The lighting system according to (14), in which the apparatus function unit of the electronic apparatus has one of a content data reproduction and output function and a content data acquisition function, the communication unit includes an apparatus-side communication unit provided to the electronic apparatus, and the apparatus-side controller is configured to execute any one of processing of causing the apparatus function unit to reproduce and output content data received by the apparatus-side communication unit from the information processing apparatus and processing of causing the apparatus-side communication unit to transmit content data acquired by the apparatus function unit to the information processing apparatus.

(17) The lighting system according to (15) or (16), in which the communication unit is configured to be capable of performing communication by Wi-Fi and communication by a wireless communication standard other than the Wi-Fi, and one of the lighting-side controller and the apparatus-side controller is configured to cause, when the content data is sound data, the communication unit to execute the communication by the wireless communication standard other than the Wi-Fi.

It should be understood by those skilled in the art that various modifications, combinations, sub-combinations and alterations may occur depending on design requirements and other factors insofar as they are within the scope of the appended claims or the equivalents thereof.

What is claimed is:

1. A lighting apparatus, comprising:

a power supply circuit;

a light-emitting unit configured to drive light emission based on a power supply voltage generated by the power supply circuit;

a mounting unit configured to detachably mount an electronic apparatus including an apparatus-side controller and an apparatus function unit controlled by the apparatus-side controller; and a lighting-side controller configured to perform control to supply an operating voltage based on the power supply voltage to the apparatus-side controller of the electronic apparatus mounted to the mounting unit to perform authentication processing with the apparatus-side controller, and perform, based on a result of the authentication processing, control to supply the operating voltage based on the power supply voltage to the apparatus function unit.

2. The lighting apparatus according to claim 1, wherein the mounting unit is configured to be capable of mounting a unit to be mounted that is provided to the electronic apparatus and has a structure common to the electronic apparatus, the electronic apparatus including a plurality of types of electronic apparatuses each including the apparatus function unit having a different function.

3. The lighting apparatus according to claim 1, wherein the lighting-side controller is configured to perform, when the authentication processing fails, control to stop power supply to the apparatus-side controller.

4. The lighting apparatus according to claim 1, further comprising a voltage level adjustment unit configured to transform the power supply voltage generated by the power supply circuit to have a requested voltage level and output the transformed power supply voltage, wherein the lighting-side controller is configured to cause the voltage level adjustment unit to generate a voltage at a level corresponding to the electronic apparatus mounted to the mounting unit.

5. The lighting apparatus according to claim 1, wherein the lighting-side controller is configured to control a light-emitting operation of the light-emitting unit in accordance with an operating state of the mounted electronic apparatus.

6. The lighting apparatus according to claim 1, further comprising a communication unit for performing data communication with an information processing apparatus.

7. The lighting apparatus according to claim 6, wherein the apparatus function unit of the electronic apparatus has one of a content data reproduction and output function and a content data acquisition function, and the lighting-side controller is configured to execute any one of processing of transferring, to the electronic apparatus, content data received by the communication unit from the information processing apparatus and processing of transferring, to the information processing apparatus via the communication unit, content data received from the electronic apparatus.

8. The lighting apparatus according to claim 7, wherein the communication unit is configured to be capable of performing communication by wireless fidelity (Wi-Fi) and communication by a wireless communication standard other than the Wi-Fi, and the lighting-side controller is configured to cause, when the content data is sound data, the communication unit to execute the communication by the wireless communication standard other than the Wi-Fi.

9. A lighting system, comprising:

an electronic apparatus; and a lighting apparatus, the electronic apparatus including an apparatus-side controller, and an apparatus function unit controlled by the apparatus-side controller, the lighting apparatus including a power supply circuit, a light-emitting unit configured to drive light emission based on a power supply voltage generated by the power supply circuit, a mounting unit configured to detachably mount the electronic apparatus, and a lighting-side controller configured to perform control to supply an operating voltage based on the power supply voltage to the apparatus-side controller of the electronic apparatus mounted to the mounting unit to perform authentication processing with the apparatus-side controller, and perform, based on a result of the authentication processing, control to supply the operating voltage based on the power supply voltage to the apparatus function unit.

10. The lighting system according to claim 9, wherein the mounting unit is configured to be capable of mounting a unit to be mounted that is provided to the electronic apparatus and has a structure common to the electronic apparatus, the electronic apparatus including a plurality of types of electronic apparatuses each including the apparatus function unit having a different function.

11. The lighting system according to claim 9, wherein the lighting-side controller is configured to perform, when the authentication processing fails, control to stop power supply to the apparatus-side controller.

12. The lighting system according to claim 9, wherein the electronic apparatus includes a voltage transformer circuit configured to transform the operating voltage supplied from the lighting apparatus based on the result of the authentication processing to have a predetermined voltage level and output the transformed operating voltage to the apparatus function unit.

13. The lighting system according to claim 9, wherein the lighting-side controller is configured to control a light-emitting operation of the light-emitting unit in accordance with an operating state of the mounted electronic apparatus.

14. The lighting system according to claim 9, further comprising:

an information processing apparatus; and a communication unit for performing one of data communication between the information processing apparatus and the lighting-side controller and data communication between the information processing apparatus and the apparatus-side controller.

15. The lighting system according to claim 14, wherein the apparatus function unit of the electronic apparatus has one of a content data reproduction and output function and a content data acquisition function, the communication unit includes a lighting-side communication unit provided to the lighting apparatus, and the lighting-side controller is configured to execute any one of processing of transferring, to the electronic apparatus, content data received by the lighting-side communication unit from the information processing apparatus and processing of transferring, to the information processing apparatus via the lighting-side communication unit, content data received from the electronic apparatus.

16. The lighting system according to claim 14, wherein the apparatus function unit of the electronic apparatus has one of a content data reproduction and output function and a content data acquisition function, the communication unit includes an apparatus-side communication unit provided to the electronic apparatus, and the apparatus-side controller is configured to execute any one of processing of causing the apparatus function unit to reproduce and output content data received by the apparatus-side communication unit from the information processing apparatus and processing of causing the apparatus-side communication unit to transmit content data acquired by the apparatus function unit to the information processing apparatus.

17. The lighting system according to claim 15 or 16, wherein the communication unit is configured to be capable of performing communication by Wi-Fi and communication by a wireless communication standard other than the Wi-Fi, and one of the lighting-side controller and the apparatus-side controller is configured to cause, when the content data is sound data, the communication unit to execute the communication by the wireless communication standard other than the Wi-Fi.

18. A control method for a lighting system including an electronic apparatus and a lighting apparatus, the electronic apparatus including an apparatus-side controller and an apparatus function unit controlled by the apparatus-side controller, the lighting apparatus including a power supply circuit, a light-emitting unit configured to drive light emission based on a power supply voltage generated by the power supply circuit, and a mounting unit configured to detachably mount the electronic apparatus, the control method comprising performing control to supply an operating voltage based on the power supply voltage to the apparatus-side controller of the electronic apparatus mounted to the mounting unit to perform authentication processing with the apparatus-side controller, and perform, based on a result of the authentication processing, control to supply the operating voltage based on the power supply voltage to the apparatus function unit.

* * * * *